US008242702B2

(12) United States Patent
Feldtkeller

(10) Patent No.: US 8,242,702 B2
(45) Date of Patent: Aug. 14, 2012

(54) METHOD FOR DRIVING A FLUORESCENT LAMP, AND LAMP BALLAST

(75) Inventor: Martin Feldtkeller, Munich (DE)

(73) Assignee: Infineon Technologies Austria AG, Villach (AT)

( * ) Notice: Subject to any disclaimer, the term of this patent is extended or adjusted under 35 U.S.C. 154(b) by 431 days.

(21) Appl. No.: 12/467,008

(22) Filed: May 15, 2009

(65) Prior Publication Data

US 2009/0284162 A1 Nov. 19, 2009

(30) Foreign Application Priority Data

May 16, 2008 (EP) ..... 08009105

(51) Int. Cl.
*H05B 37/02* (2006.01)

(52) U.S. Cl. ..... 315/224; 315/209 R; 315/246; 315/291; 315/307

(58) Field of Classification Search ..... 315/209 R, 315/224, 246, 291, 307
See application file for complete search history.

(56) References Cited

U.S. PATENT DOCUMENTS

| | | | | |
|---|---|---|---|---|
| 6,525,492 | B2 | 2/2003 | Ribarich | |
| 6,590,351 | B2 * | 7/2003 | Huber | 315/291 |
| 6,617,805 | B2 | 9/2003 | Ribarich et al. | |
| 6,667,585 | B2 * | 12/2003 | O'Meara | 315/291 |
| 7,990,073 | B2 * | 8/2011 | Feldtkeller | 315/291 |
| 2003/0227264 | A1 | 12/2003 | Busse et al. | |
| 2004/0085031 | A1 * | 5/2004 | Hsieh | 315/291 |
| 2005/0218831 | A1 | 10/2005 | Haque | |
| 2006/0226794 | A1 * | 10/2006 | Takahashi et al. | 315/308 |
| 2007/0057639 | A1 | 3/2007 | Sun et al. | |
| 2008/0054825 | A1 * | 3/2008 | Gulsen et al. | 315/307 |
| 2008/0150442 | A1 | 6/2008 | Feldtkeller | |

FOREIGN PATENT DOCUMENTS

| | | | |
|---|---|---|---|
| DE | 102004037389 | A1 | 3/2006 |
| EP | 0474287 | A1 | 3/1992 |
| EP | 1066739 | B1 | 2/2002 |
| EP | 1333707 | A1 | 8/2003 |
| EP | 1337133 | A2 | 8/2003 |
| EP | 1776000 | A2 | 4/2007 |
| WO | 9934647 | A1 | 7/1999 |
| WO | 2005101921 | A2 | 10/2005 |
| WO | 2006003560 | A1 | 1/2006 |
| WO | 2007104666 | A1 | 9/2007 |

* cited by examiner

*Primary Examiner* — Jason M Crawford
(74) *Attorney, Agent, or Firm* — Dicke, Billig & Czaja, PLLC

(57) ABSTRACT

A method for driving a fluorescent lamp and lamp ballast is disclosed. In one embodiment, an excitation AC voltage having an excitation frequency is applied to the series resonant circuit using a half-bridge circuit, having an output, to which the series resonant circuit is coupled, and having a first and a second switch, which are driven in the on state and in the off state with a fundamental frequency predetermined by a frequency signal or with an increased frequency. The switches are driven with the fundamental frequency or with the increased frequency with respect to the fundamental frequency in a manner dependent on a temporal change in the resonant circuit current between two temporally spaced-apart evaluation instants lying within a switched-on duration of one of the switches.

19 Claims, 14 Drawing Sheets

METHOD FOR DRIVING A FLUORESCENT LAMP, AND LAMP BALLAST

CROSS-REFERENCE TO RELATED APPLICATIONS

This Utility Patent Application claims priority to European Patent Application No. EP 08 009 105.1-1239 filed on May 16, 2008, which is incorporated herein by reference.

BACKGROUND

The present invention relates to a method for driving a fluorescent lamp, in one embodiment for igniting the fluorescent lamp, and a lamp ballast.

Lamp ballasts for fluorescent lamps or gas discharge lamps usually include a half-bridge circuit and a series resonant circuit connected to the half-bridge circuit, which series resonant circuit can be connected to the fluorescent lamp. In this case, the half-bridge circuit serves for exciting the series resonant circuit and for this purpose generates an AC voltage from a DC voltage present across the half-bridge.

A start phase of a lamp ballast includes, for example, a preheating phase and an ignition phase for igniting the lamp. During the preheating phase, incandescent filaments of the lamp are heated by setting a frequency of the AC voltage, which is referred to hereinafter as excitation frequency, in such a way that it lies above the resonant frequency of the series resonant circuit. During the ignition phase, the excitation frequency is increasingly reduced in the direction of the resonant frequency of the resonant circuit, with the aim of increasing a voltage across the fluorescent lamp by using a resonance magnification to an extent such that an ignition voltage of the lamp is obtained and the lamp ignites. During an operating phase after ignition of the lamp, the excitation frequency can then be reduced still further.

During the ignition phase, it should in this case be ensured, on the one hand, that the voltage across the lamp can rise up to the value of the ignition voltage. On the other hand, it should be ensured for safety reasons that the voltage does not rise to an arbitrary extent, for example, when the lamp does not ignite on account of a defect or when no lamp is connected to the resonant circuit. In this respect, U.S. Pat. No. 6,525,492 proposes detecting a current through the half-bridge and immediately switching off the half-bridge if the current exceeds a predetermined threshold value.

For cost reasons, the coil of the resonant circuit is often dimensioned such that it already operates in the vicinity of its magnetic saturation if the lamp voltage lies in the region of the ignition voltage. As is known, the effective inductance of a coil decreases upon transition to the saturation range. If, during the ignition process, an excitation frequency is attained at which the coil begins to go to saturation, then the resonant frequency of the series resonant circuit increases owing to the decreasing inductance of the coil, and a separation between the instantaneous excitation frequency and the resonant frequency decreases. With the excitation frequency remaining constant, the voltage rises further as a result, the coil goes further to saturation and the resonant frequency further approaches the instantaneous excitation frequency. As a result of this positive feedback effect explained, instabilities can arise in the setting of the ignition voltage.

For these and other reasons, there is a need for the present invention.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

Figure 1:
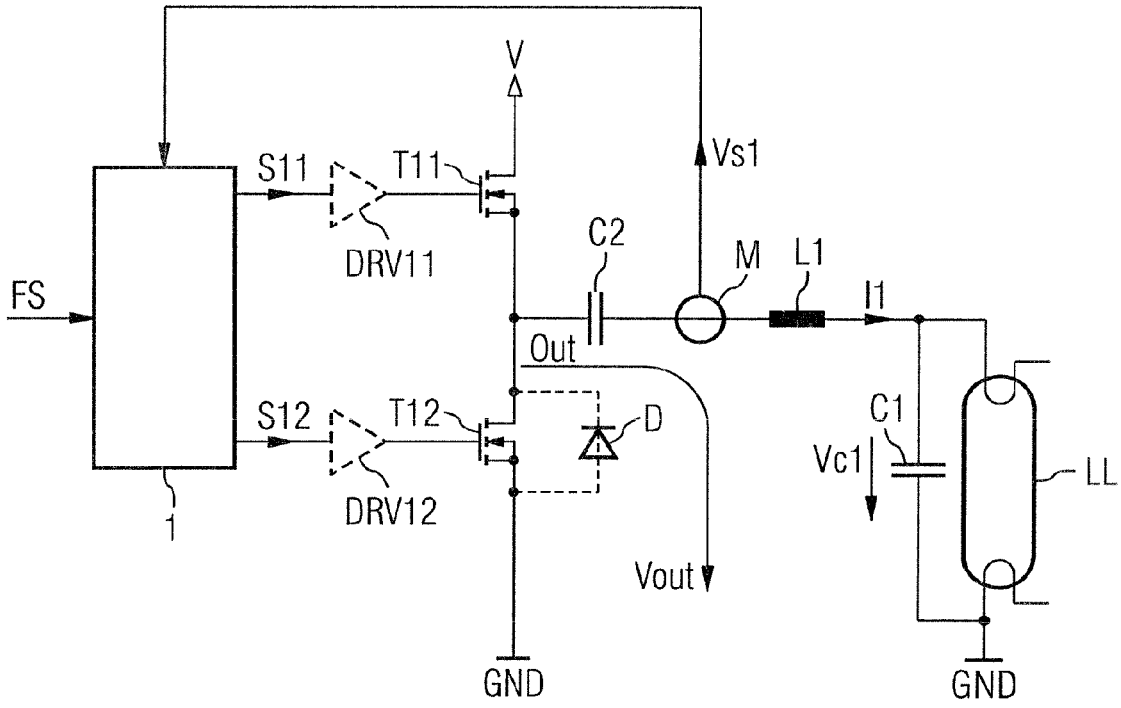
FIG. 1 illustrates the basic construction of a lamp ballast in accordance with one embodiment for driving a fluorescent lamp, which lamp ballast includes a half-bridge having two switches and a series resonant circuit coupled to the half-bridge.

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

One embodiment of a method for driving a fluorescent lamp connected to a series resonant circuit including a resonant circuit inductance and a resonant circuit capacitance, includes: applying an excitation AC voltage having an excitation frequency to the series resonant circuit using a half-bridge circuit, having an output, to which the series resonant circuit is coupled, and having a first and a second switch, which are driven in the on state and in the off state with a fundamental (basic) frequency predetermined by a frequency signal or with a lower frequency with respect to the fundamental frequency; detecting a resonant circuit current flowing through the resonant circuit; and driving the switches with the fundamental frequency or with the lower frequency with respect to the fundamental frequency in a manner dependent on a temporal change in the resonant circuit current between two temporally spaced-apart evaluation instants lying within a switched-on duration of one of the switches.

One embodiment of a lamp ballast includes: a series resonant circuit having connection terminals for connecting a fluorescent lamp; a half-bridge circuit having a first and a second switch and having an output, which is connected to the series resonant circuit; a drive circuit, which can assume a first and a second operating state and which is designed to drive first and second switches alternately in the on state and in the off state with a fundamental frequency dependent on a frequency signal or with a lower frequency with respect to the fundamental frequency, and is designed to detect a current through the resonant circuit and, in a manner dependent on a temporal change in the resonant circuit current between two temporally spaced-apart evaluation instants lying within a switched-on duration of one of the switches to drive the switches with the fundamental frequency or with a lower frequency with respect to the fundamental frequency.

In the figures, unless indicated otherwise, identical reference symbols designate identical circuit components and signals with the same meaning.

FIG. 1 illustrates one embodiment of a drive circuit for driving a fluorescent lamp LL. This drive circuit, also referred to as a lamp ballast, includes a series resonant circuit having a resonant circuit inductance L1 and a resonant circuit capacitance C1 connected in series with the resonant circuit inductance L1. During the operation of the lamp ballast, a fluorescent lamp LL is coupled to the series resonant circuit via heating filaments. Referring to FIG. 1, for this purpose the fluorescent lamp LL can be connected in parallel with the resonant circuit capacitance C1. Free ends of the heating filaments that are remote from the resonant circuit capacitance C1 can be connected to a heating circuit in a manner not illustrated more specifically.

The lamp ballast additionally includes a half-bridge circuit having a first and a second switch T11, T12, which each have a drive connection and load paths. In this case, the load paths of the switches T11, T12 are connected in series with one another between terminals for a positive supply potential V and a negative supply potential or reference-ground potential GND. The half-bridge circuit has an output OUT, which is formed by a node common to the load paths of the switches T11, T12 and to which the series resonant circuit L1, C1 is coupled. In this case, the series resonant circuit L1, C1 is connected between the output OUT and the terminal for the second supply potential GND. In the example, a coupling capacitor C2 is connected between the output OUT and the series resonant circuit L1, C1, the coupling capacitor serving for blocking DC components in an excitation AC voltage Vout generated by the half-bridge circuit T11, T12 for the series resonant circuit L1, C1.

The half-bridge circuit T11, T12 serves for applying an excitation AC voltage having an excitation frequency to the series resonant circuit. During operation, the switches T11, T12 are for this purpose driven alternately in the on state and in the off state by a drive circuit 1 yet to be explained. When the first switch T11, which is also referred to as high-side switch or upper half-bridge switch, is driven in the on state and the second switch T12, which is also referred to as low-side switch or lower half-bridge switch, is driven in the off state, a voltage corresponding to the supply voltage present between the supply potential terminals is present across the series resonant circuit L1, C1. When the high-side switch T11 is in the off state and the low-side switch T12 is in the on state, the voltage across the series resonant circuit is approximately zero.

In the lamp ballast illustrated in FIG. 1, the switches T11, T12 of the half-bridge circuit are embodied as n-conducting MOSFETs each having a gate connection as control connection and drain and source connections as load path connections. It should be pointed out in this context that any desired switches can be used as switches of the half-bridge circuit, in one embodiment other semiconductor switches such as p-conducting MOSFETs or IGBTs. There is the possibility, in one embodiment, of using complementary semiconductor switches, for example of realizing the high-side switch T11 as a p-MOSFET and the low-side switch T12 as an n-MOSFET.

In one embodiment for reliably avoiding shunt currents, the switches T11, T12 are driven in such a way that a wait during a waiting time, the dead time, is effected between driving one switch in the off state and driving the other switch in the on state. During this dead time, a freewheeling current of the series resonant circuit can be accepted by a freewheeling element, such as a diode D for example, connected in parallel with the low-side switch. When an n-conducting MOSFET is used as the low-side switch, a body diode integrated in the MOSFET can fulfill this freewheeling function, such that an external freewheeling element can be dispensed with.

For driving the switches T11, T12 of the half-bridge circuit, a drive circuit 1 is present, which generates a first drive signal S11 for driving the high-side switch T11 and a second drive signal S12 for driving the low-side switch T12. Driver circuits DRV11, DRV12 are optionally connected upstream of the drive connections of the switches T11, T12, the driver circuits serving for converting signal levels of the drive signals S11, S12 to those signal levels which are suitable for driving the switches T11, T12.

A frequency signal FS is fed to the drive circuit 1, which frequency signal determines the frequency with which the switches T11, T12 are mutually alternately driven, and thus determines the excitation frequency of the series resonant circuit L1, C1. The frequency signal FS is generated for example by a central control circuit, which controls the operation of the lamp ballast, in a manner not illustrated more specifically.

Figure 2:
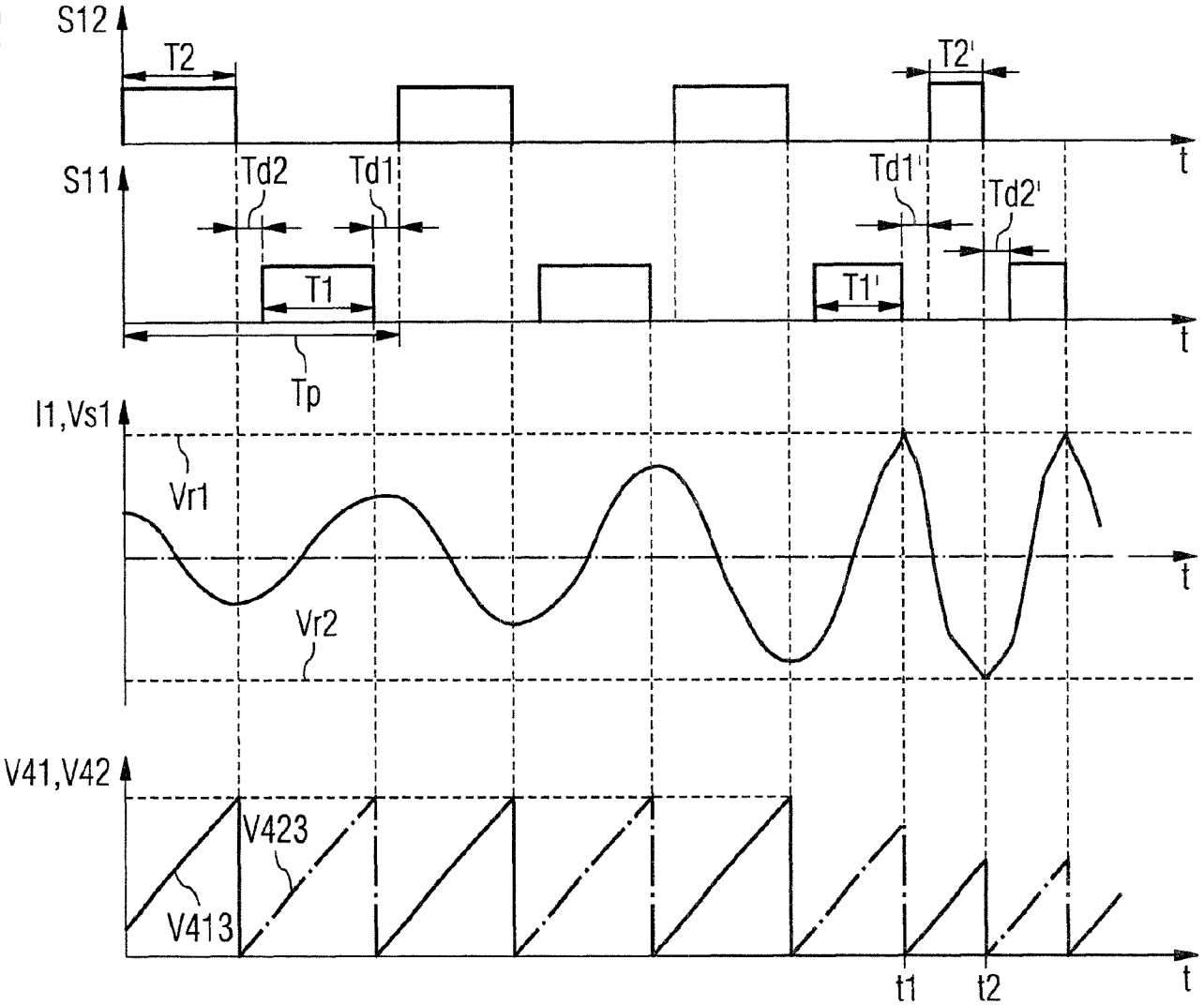
FIG. 2 illustrates one embodiment of a method for driving the fluorescent lamp on the basis of selected signals occurring in the lamp ballast, which method is realized by the lamp ballast.

Temporal profiles of the first and second drive signals S11, S12 generated by the drive circuit 1 are illustrated by way of example in FIG. 2. Without restricting the invention with regard thereto, it is assumed for the following explanation that the drive signals S11, S12 are two-valued signals that alternately assume a switch-on level and a switch-off level, and that the switches T11, T12 are turned on in the case of a switch-on level of the respective drive signal S11, S12 and are turned off in the case of a switch-off level of the respective drive signal. For the purposes of the following explanation it should be assumed that the switch-on level is a high level and the switch-off level is a low level of the respective drive signal S11, S12.

During a drive period, which is designated by Tp in FIG. 2, successively the first switch T11 is driven in the on state for a first switched-on duration T1 and the second switch T12 is driven in the on state for a second switched-on duration T2. The excitation frequency f of the voltage applied to the series resonant circuit L1, C1 via the half-bridge circuit T11, T12 in this case corresponds to the reciprocal of the period duration, such that the following holds true: f=1/Tp.

Between two successive switched-on durations T1, T2 during which one of the drive signals S11, S12 respectively assumes a switch-on level, there is a waiting time, which is referred to hereinafter as dead time, during which both drive signals S11, S12 assume a switch-off level. In FIG. 2, Td1 designates a first dead time after a switched-on duration of the first switch T11 and before a switched-on duration of the second switch T12. Td2 designates a second dead time after a switched-on duration of the second switch T12 and before a switched-on duration of the first switch T11. For reasons of a simplified illustration, the drive signals S11, S12 in FIG. 2 are illustrated as rectangular signals having signal edges proceeding with infinite steepness. In actual fact, of course, these signals have switching edges having a finite edge steepness. The dead times Td1, Td2 ensure that the two switches T11, T12 are not turned on simultaneously, with the result that shunt currents are reliably avoided.

FIG. 2 illustrates, in addition to the drive signals S11, S12, the temporal profile of a current I1 through the series circuit, or of a current measurement signal generated by a measurement arrangement M connected in the series resonant circuit. The current measurement signal Vs1 in this case is at least approximately proportional to the resonant circuit current I1. FIG. 2 illustrates the temporal profile of this current I1 for a time period before ignition of the fluorescent lamp LL. In this case, the current I1 through the series resonant circuit has an at least approximately sinusoidal profile, and the frequency of this sinusoidal signal profile corresponds to the excitation frequency f. For the ignition of the fluorescent lamp, the excitation frequency, under the control of the frequency signal FS, is gradually reduced proceeding from an initial value lying above a resonant frequency of the resonant circuit L1, C1. This is tantamount to lengthening the period duration Tp and thus to lengthening the first and second switched-on durations T1, T2. In this case, the dead times Td1, Td2 can be independent of the switched-on durations T1, T2 and can have a predetermined constant value. However, the dead times can also be variable.

A reduction of the excitation frequency of the AC voltage that excites the resonant circuit L1, C1 in the direction of the resonant frequency brings about an increase in a maximum amplitude value of the current I1 flowing through the series resonant circuit or an AC voltage Vc1 present across the resonant circuit capacitor C1. The temporal profile of the voltage Vc1 follows the temporal profile of the current I1 in a phase-shifted manner. If, with a decreasing excitation frequency, the voltage attains the value of the ignition voltage of the fluorescent lamp LL and the fluorescent lamp ignites, then the excitation frequency can be reduced further down to the value of an operating frequency by using the control circuit 1. After ignition, the energy consumed by the fluorescent lamp is subsequently supplied by using the excitation voltage; in a manner not illustrated more specifically, the current profile is no longer sinusoidal when the fluorescent lamp has been ignited. The reduction of the frequency to the operating frequency after ignition of the fluorescent lamp can be effected by using conventionally known measures, and so further explanations in this respect can be dispensed with.

In order to minimize the material costs for the resonant circuit inductance L1, it is desirable to choose the resonant circuit inductance L1 such that the latter is operated in the region of its magnetic saturation if the resonant circuit current I1 rises up to a value at which the lamp ignites. The feedback effect explained in the introduction can occur in this case.

In order to avoid negative effects of this feedback effect, it is provided that, during an ignition process, that is to say during a time duration during which the fluorescent lamp LL has not yet ignited, the resonant circuit inductance L1 is monitored with regard to an incipient saturation and the switched-on durations of the first and second switches T11, T12 are shortened upon detection of such an incipient saturation. An incipient saturation of the resonant circuit inductance L1 can be detected for example by a comparison of the measurement signal Vs1 proportional to the resonant circuit current I1 with a first and a second threshold value Vr1, Vr2. If the measurement signal Vs1 rises up to the value of the first threshold value Vr1 when the first switch is driven in the on state, then the first switch T11 is switched off directly and before the "normal" switched-on duration dependent on the excitation frequency has actually been attained. If the measurement signal Vs1 attains the value of the lower threshold value Vr2 when the second switch T12 is driven in the on state, then the second switch is switched off directly and before the switched-on duration dependent on the excitation frequency has actually been attained. This leads in each case to shortenings of the switched-on durations of the first and second switches T11, T12 relative to the switched-on durations dependent on the instantaneous excitation frequency. In the case where one of the switches is prematurely switched off owing to saturation as explained, a wait during a dead time Td1' or Td2' is effected before the other switch is switched on, where these dead times can be identical in each case and can correspond in one embodiment to the dead times Td1, Td2 during those operating phases in which no premature switching off owing to saturation takes place. A premature switching off of the switches owing to saturation effectively leads to a raising of the excitation frequency and thus counteracts a further resonance magnification and thus a further rising of the voltage in the resonant circuit L1, C1. In one embodiment, the positive feedback effect explained in the introduction is thereby avoided.

Figure 3:
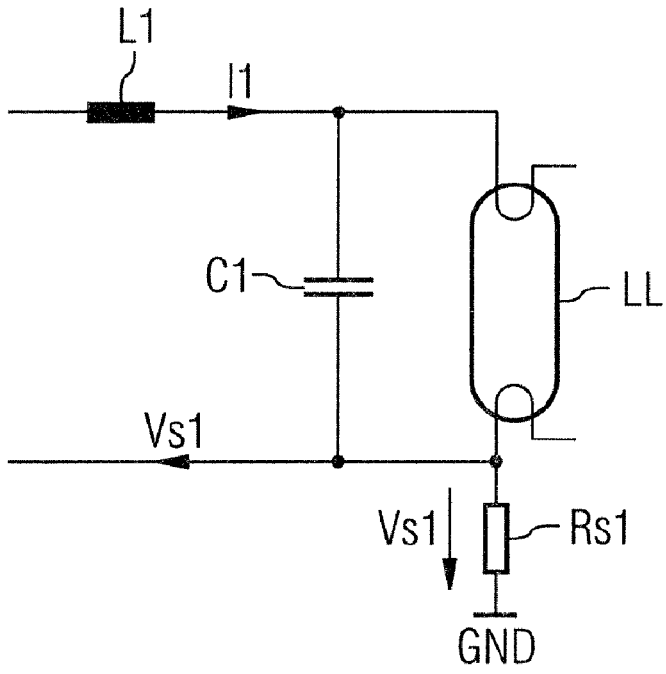
FIG. 3 illustrates one embodiment for detecting a current through a series resonant circuit.

The measurement signal Vs1 at least approximately proportional to the resonant circuit current I1 can be generated in various ways. FIG. 3 illustrates as an excerpt a lamp ballast wherein, in order to provide the measurement signal Vs1, a measuring resistor Rs1 having an at least approximately ohmic resistance behavior, is connected in series with the series resonant circuit L1, C1 and in the example between the series resonant circuit L1, C1 and the second supply potential GND. A voltage across the measuring resistor Rs1 in this case corresponds to the current measurement signal Vs1.

Figure 4:
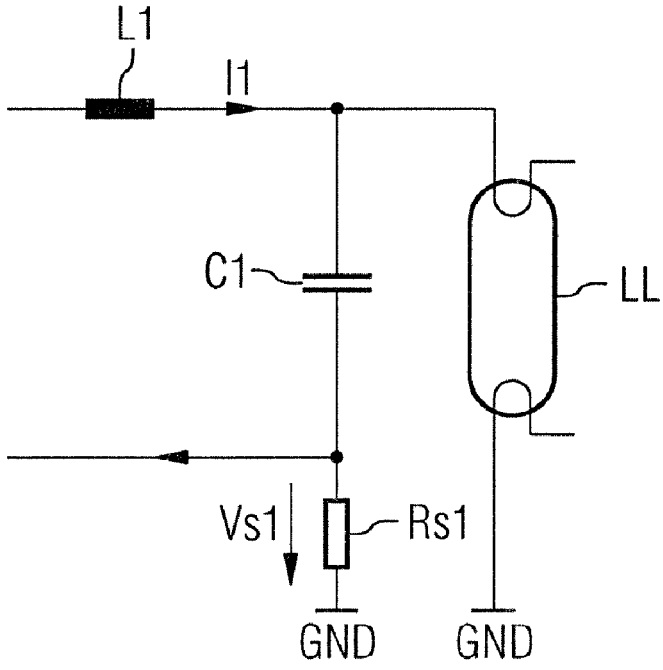
FIG. 4 illustrates one embodiment for detecting the current through a series resonant circuit.

In the lamp ballast in accordance with FIG. 3, the measuring resistor Rs1 is connected to the parallel circuit formed by the resonant circuit capacitance C1 and the fluorescent lamp LL. FIG. 4 illustrates a modification of the lamp ballast illustrated in FIG. 3, wherein the measuring resistor Rs1 is likewise connected between the series resonant circuit L1, C1 and the terminal for the second supply potential GND, but wherein the fluorescent lamp LL is connected in parallel with a series circuit including the resonant circuit capacitor C1 and the measuring resistor Rs1. In the method explained above, the resistance value of the measuring resistor Rs1, the first and second threshold values Vr1, Vr2 and a quotient of the inductance value of the resonant circuit inductance and the capacitance value of the resonant circuit capacitance determine a maximum ignition voltage that occurs.

In the method explained above, a premature switching off of the first and second switches T11, T12 upon an incipient saturation of the resonant circuit inductance requires information about the current I1 flowing through the resonant circuit during the entire drive period of the resonant circuit. In this method explained, symmetrical operation of the half-bridge is achieved, that is to say that upon incipient saturation both the switched-on duration of the first switch T11 and the switched-on duration of the second switch T12 are shortened.

Figure 5:
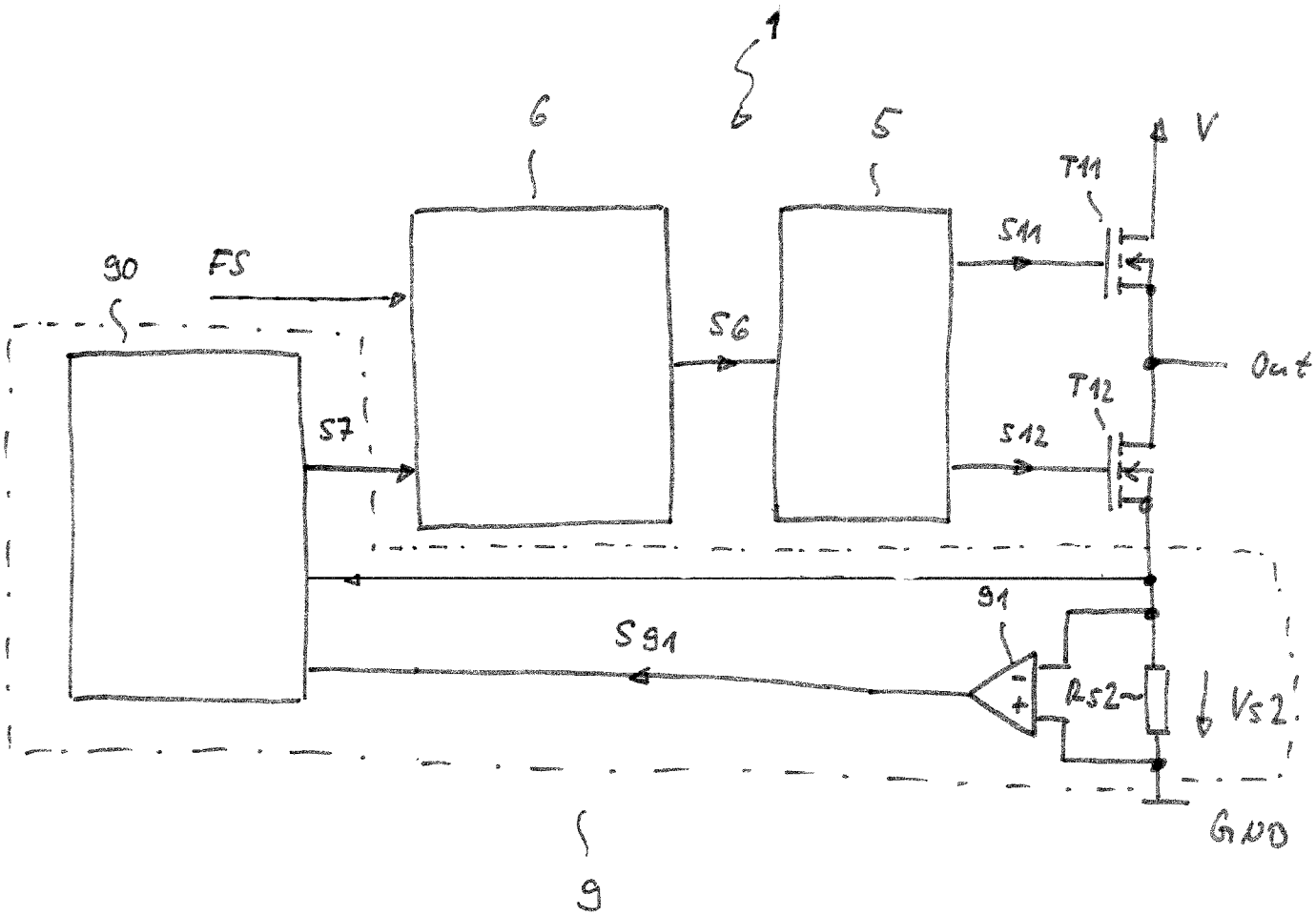
FIG. 5 illustrates a block diagram of a lamp ballast including an oscillator, a drive signal generating circuit and a switched-on duration control circuit.

A further method for shortening the switched-on duration or for raising the drive frequency, and a lamp ballast having such functionality are explained below. FIG. 5 illustrates a block diagram of one example of such a lamp ballast.

The lamp ballast illustrated in FIG. 5 includes a half-bridge having a first and a second switch T11, T12 and a series resonant circuit L1, C1 connected to an output OUT of the half-bridge T11, T12, to which series resonant circuit a fluorescent lamp LL can be connected during operation of the lamp ballast. In order to provide drive signals S11, S12 for the switches T11, T12 of the half-bridge, a drive circuit 1 is present. In the example illustrated, the drive circuit has an oscillator 6 for providing an oscillator signal S6. The oscillator signal predetermines a frequency with which the two switches T11, T12 of the half-bridge circuit are intended to be driven. The oscillator signal S6 is fed to a drive signal generating circuit 5, which generates the drive signals S11, S12 in a manner dependent on the oscillator signal S6 in such a way that the two switches T11, T12 are in each case driven in the on state alternately with the timing of the oscillator signal S6 and that a dead time is in each case present between driving one switch in the on state and driving the respective other switch in the on state. In this case, each of the drive signals S11, S12 is provided by the drive signal generating circuit in such a way that the respective switch T11, T12 to which the drive signal is fed is driven in the on state in a manner clocked with a switching frequency that is dependent on the frequency of the oscillator signal S6. In this case, the frequency with which the two switches are driven in the on state in a manner phase-shifted with respect to one another can correspond to the frequency of the oscillator signal, but can also be a fraction, such as, for example, half, or a multiple of the frequency of the oscillator signal S6.

The oscillator 6 can assume two different operating states: a first operating state, which is referred to hereinafter as the normal operating state; and a second operating state, which is referred to hereinafter as the saturation operating state. In the normal operating state, the oscillator 6 generates the oscillator signal S6 with a predetermined frequency. This frequency is for example predetermined by the frequency signal FS or dependent on the frequency signal and is referred to hereinafter as the fundamental frequency. This fundamental frequency can change during an ignition process in a manner that has already been explained in principle. In the saturation operating state, the oscillator 6 generates the oscillator signal S6 for a frequency that is higher than the fundamental frequency, in order thereby to counteract the explained positive feedback effect upon an incipient saturation of the resonant circuit inductance L1.

The operating state of the oscillator 6 is dependent on a switched-on duration control signal S7, which is generated by a switched-on duration control circuit 9. In order to generate the switched-on duration control signal S7, the switched-on duration control circuit 9 evaluates a measurement signal Vs2, which is dependent on the resonant circuit current (I1 in FIG. 1) and which, in one embodiment, is proportional to the resonant circuit current. In a manner that will additionally be explained below, the switched-on duration control circuit 7 is designed to generate the switched-on duration control signal S7 in a manner dependent on the phase angle of the measurement signal Vs2 relative to the phase of the clock signal S6 or the phase of one of the two drive signals S11, S12 and in a manner dependent on the temporal profile of the measurement signal Vs2 during one or a plurality of drive periods Tp.

In order to provide the measurement signal Vs2, in the example illustrated, a measuring resistor Rs2 is present, which is connected in series with the switches T11, T12 of the half-bridge and in the example illustrated between the second switch T12 and the lower supply potential or reference-ground potential. It should be pointed out in this context that an upper supply potential of the drive circuit 1 and an upper supply potential of the half-bridge T11, T12 are different. While the upper supply potential of the half-bridge can assume values up to a few hundred volts, the upper supply potential of the drive circuit 1 is in the region of a few volts, for example. By contrast, the lower supply potential of the half-bridge can correspond to the lower supply potential of the drive circuit 1 and can be for example a reference-ground potential, in one embodiment ground.

In the lamp ballast illustrated, the resonant circuit current I1 is measured only during part of the drive period, namely when the second switch T12 is driven in the on state or when a freewheeling diode integrated in the second switch T12 or an external freewheeling diode (not illustrated) is turned on. A temporal profile of a measurement voltage Vs2 present across the measuring resistor Rs2 is illustrated schematically in FIG. 6 as a function of the clock signal S6 and the drive signals S11, S12 resulting therefrom. The measurement signal Vs2 follows the current I1 through the resonant circuit after the first switch T11 has been turned off until the second switch T12 is turned off, and is otherwise zero. Instead of a measurement signal Vs2 generated by using a measuring resistor Rs2 connected in series with the half-bridge T11, T12, the switched-on duration control circuit 9 could also evaluate a measurement signal Vs1 generated in accordance with the explanations concerning FIGS. 2 and 3. Instead of a measuring resistor, moreover, use could be made of any other current measurement arrangement suitable for generating a measurement signal Vs2 dependent on the resonant circuit current I1—and in one embodiment one proportional to the resonant circuit current I1. The current measurement could be effected according to the "current sense principle" in one embodiment. In this case, the current flowing through a power transistor is evaluated directly.

Figure 7:
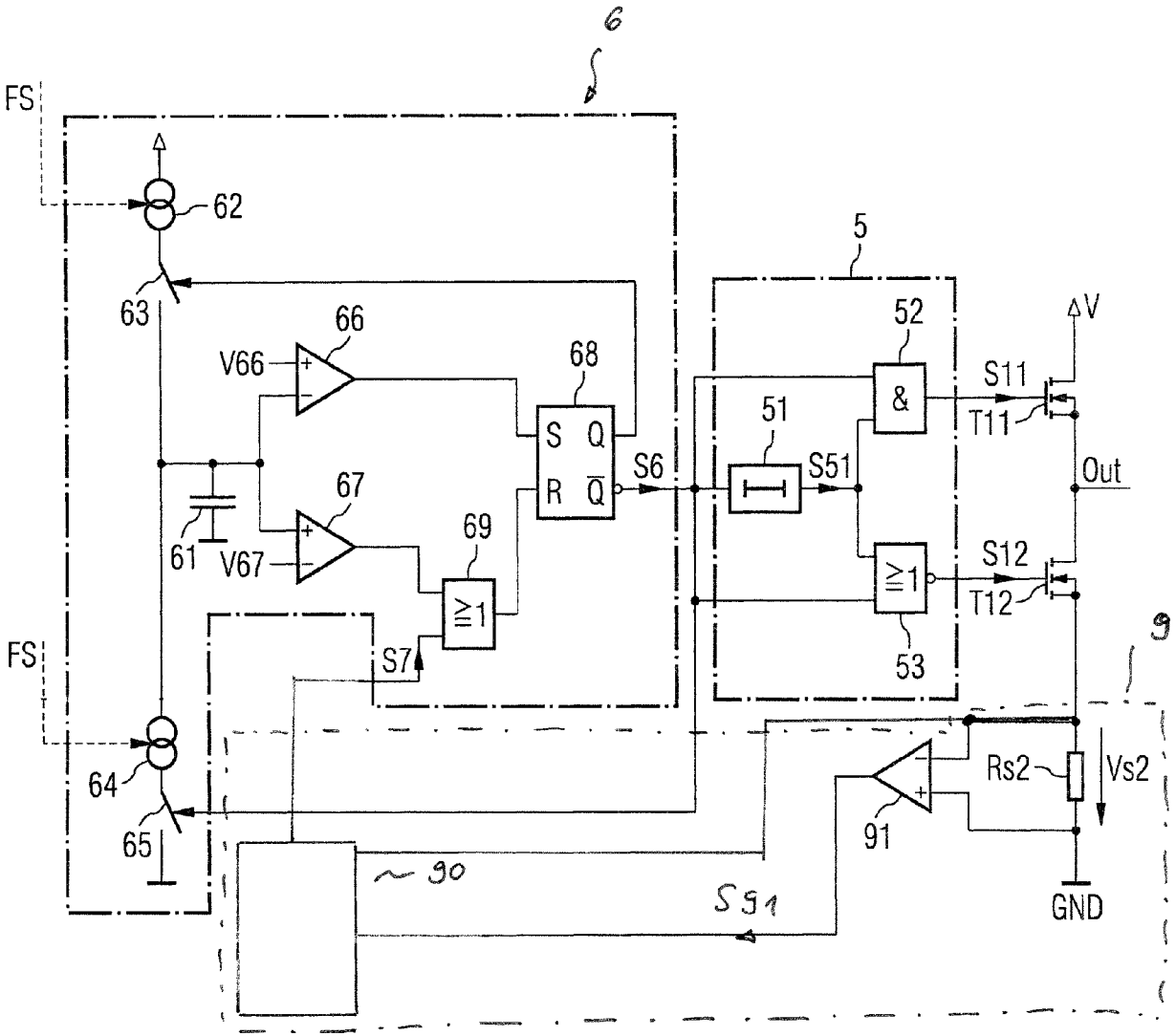
FIG. 7 illustrates realizations of the oscillator and of the drive signal generating circuit.

One possible realization of the oscillator 6 and one possible realization of the drive signal generating circuit 5 are explained below with reference to FIG. 7.

The oscillator 6 illustrated generates a clock signal S6 that alternately assumes a first level, a high level in the example, and a second level, a low level in the example. In the example, the oscillator 6 includes for this purpose a capacitive storage element 61 having a first connection, which is connected to an upper supply potential or positive supply potential via a series circuit including a first current source 62 and a first switch 63 and which is connected to a second supply potential or reference-ground potential via a series circuit including a second current source 64 and a second switch 65. In this case, the upper supply potential can in one embodiment be lower than an upper supply potential of the half-bridge T11, T12.

A second connection of the capacitive storage element 61 which is realized as a capacitor, for example, is connected to the second supply potential in the example. The capacitive storage element 61 is alternately charged via the first series circuit 62, 63 and discharged via the second series circuit 64, 65. In this case, a voltage V61 present across the capacitive storage element 61 has a triangular signal profile, which is illustrated by way of example in FIG. 6. An alternate activation of the first and second series circuits for charging and discharging the storage element 61 is effected via a flip-flop 68 having a noninverting output and an inverting output. In this case, the first switch 63 of the first series circuit is driven via the noninverting output of the flip-flop 68, and the second switch 65 of the second series circuit is driven via the inverting output of the flip-flop 68. For explanation purposes it should be assumed that the switches 63, 65 are in each case driven in the on state in the case of a high level of the associated flip-flop output signal and driven in the off state in the case of a low level of the respective flip-flop output signal. Since a high level is present in each case alternately at the outputs of the flip-flop 68, an alternate activation of the series circuits is ensured.

Figure 6:
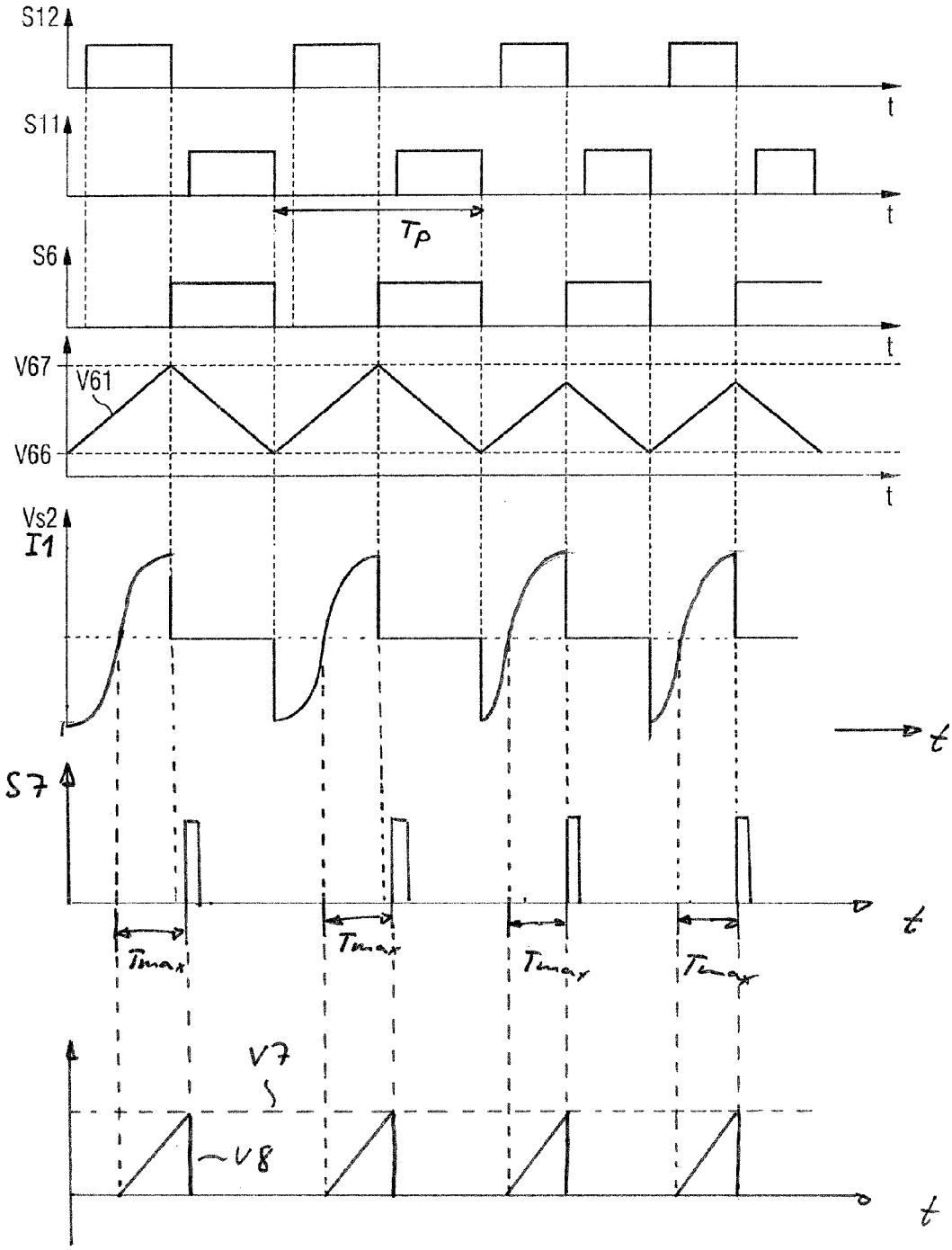
FIG. 6 illustrates temporal profiles of some signals occurring in the lamp ballast.

In the case of the oscillator illustrated in FIG. 6, the clock signal S6 is present at the inverting output of the flip-flop 68 and thus assumes its first level (high level) when the flip-flop 68 is reset, and its second level (low level) when the flip-flop is set. The clock signal S6 is fed to the drive signal generating circuit 5, which generates the first and second drive signals S11, S12 in a manner dependent on this oscillator signal S6. The drive signal generating circuit 5 illustrated in FIG. 7 is designed to drive the two switches in the on state in a manner phase-shifted with respect to one another in each case with the frequency of the oscillator signal S6. In this case, the two switches T11, T12 are driven in the on state in each case after the elapsing of a dead time predetermined by the drive signal generating circuit 5—the dead time additionally being explained below—after a state change of the flip-flop 68. In the example illustrated, the first switch T11 is driven in the on state after the dead time has elapsed after the resetting of the flip-flop 68 and the second switch T12 is driven in the on state after the dead time has elapsed after the setting of the flip-flop 68. The two switches T11, T12 are driven in the off state directly when a state change of the flip-flop occurs which is complementary to the state change for which driving in the on state was effected, that is to say that the first switch T11 is turned off directly upon the setting of the flip-flop 68 and the second switch T12 is turned off directly upon the resetting of the flip-flop. In this context, "directly" means that no minimum delay time between the state change of the flip-flop 68 and the turning off of the respective switch T11, T12 is provided, rather that delays occur only on account of unavoidable signal propagation times and on account of switching delays of the first switches T11, T12.

The flip-flop 68 is set and reset in a manner dependent on a comparison of the capacitor voltage V61 with an upper and a lower threshold value V67, V66. In the circuit illustrated, the flip-flop 68 is reset if the capacitor voltage V61 rises up to the upper threshold value V67 when the first switch 63 is driven in the on state, and is set if the capacitor voltage V61 falls to the lower threshold value V66 when the second switch 65 is driven in the on state. In this case, the capacitive voltage V61 and the lower threshold value V66 are fed to a first comparator 66, which has an output connected to the set input of the flip-flop 68. The capacitor voltage V61 and the upper threshold value V67 are correspondingly fed to a second comparator 67, the output of which is fed to the reset input R of the flip-flop 68 via an OR gate 69, yet to be explained. The functioning of this oscillator arrangement 6 is briefly explained below:

If the flip-flop 68 is set, then the first series circuit is activated, whereby the capacitor voltage V61 rises. If the rising capacitor voltage V61 in this case attains the upper threshold value V67, then the flip-flop 68 is reset, whereby the first series circuit 62, 63 is deactivated and the second series circuit 64, 65 is activated. The capacitor 61 is then discharged, whereby the capacitor voltage V61 decreases. If the capacitor voltage V61 in this case attains the lower threshold value V66 then the flip-flop 68 is set again and, as a result, the upper series circuit 62, 63 is activated and the lower series circuit 64, 65 is deactivated. As is illustrated in FIG. 6, in the example illustrated, the clock signal S6 assumes a high level in the case of a falling capacitor voltage V61 and a low level in the case of a rising capacitor voltage.

Figure 8:
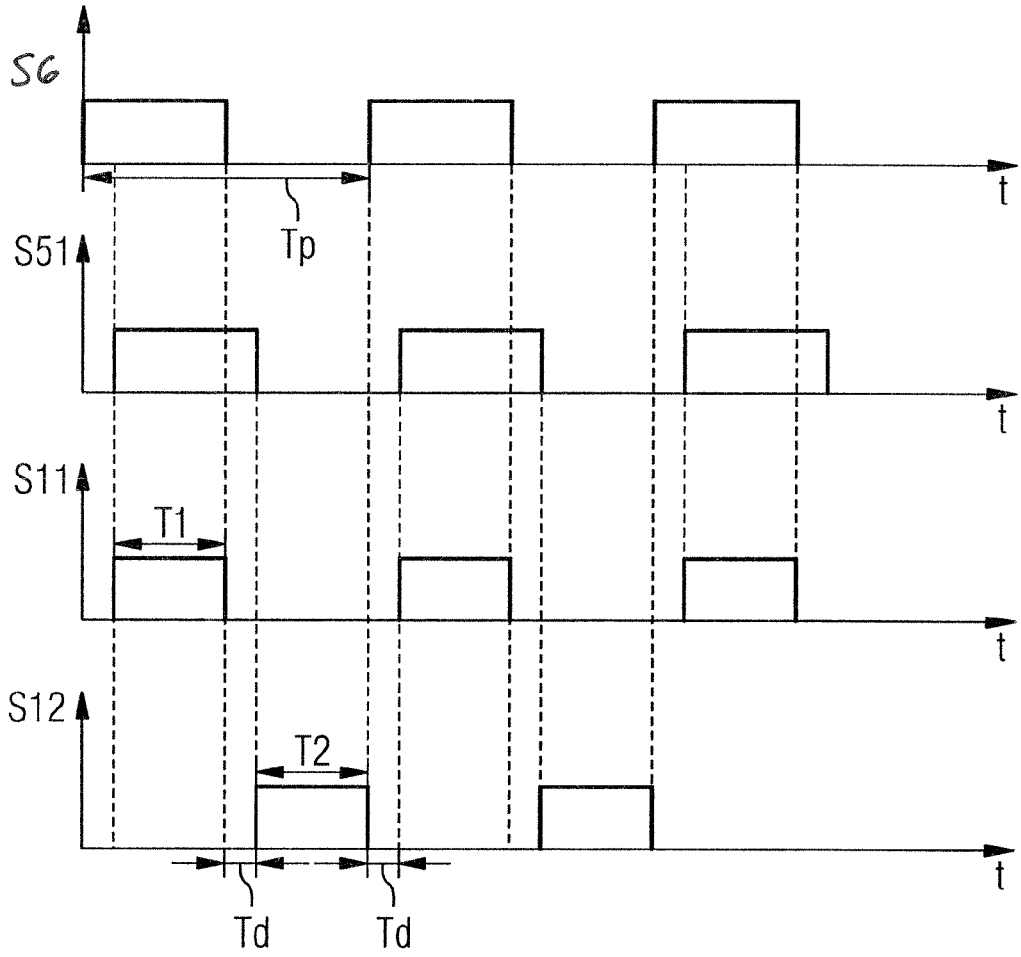
FIG. 8 illustrates the functioning of the drive signal generating circuit on the basis of signal profiles.

In the embodiment illustrated, the drive signal generating circuit 5 includes a delay element 51, to which the clock signal S6 is fed and which generates an output signal S51, which corresponds to the clock signal S6 delayed by a delay duration Td. A temporal profile of the output signal S51 is illustrated in FIG. 8 as a function of the clock signal S6. The drive signal generating circuit 5 additionally has two logic gates 52, 53, to each of which the clock signal S6 and the delayed clock signal S51 are fed and respectively generate one of the drive signals S11, S12. The first drive signal S11 is available at the output of the first logic gate 52, which is realized as an AND gate in the example. The drive signal S11 assumes a switch-on level—a high level in the example—during those time durations during which the clock signal S6 and the delayed clock signal S51 have a high level. A temporal profile of this first drive signal S11 resulting from the clock signal S6 and the delayed clock signal S51 is likewise illustrated in FIG. 6. The second drive signal S12 is available at the output of the logic gate 53, which is realized as a NOR gate in the example. The drive signal S12 assumes a switch-on level—a high level in the example—during those time durations during which both the clock signal S6 and the delayed clock signal S51 assume a low level.

A dead time between a switch-on level of the first drive signal S11, that is to say driving the first switch T11 in the on state, and a switch-on level of the second drive signal S12 that is to say driving the second switch T12 in the on state, is determined by the delay time Td of the delay element 51 in the drive signal generating circuit 5 illustrated. During this dead time, the clock signal S6 and the delayed clock signal S51 each have mutually complementary signal levels, such that both the first and the second drive signal S11, S12 assume a low level. Dead times between the first switch T11 being turned off and the second switch T12 being turned on and between the second switch T12 being turned off and the first switch T11 being turned on are identical in this drive signal generating circuit 5. The delay element 51 can have a fixedly predetermined delay time, but can also be adjustable with regard to its delay time. In the latter case mentioned, the dead time can be set via the delay element.

In the drive circuit 1 illustrated, the switched-on duration control circuit 9 is designed to generate the switched-on duration control signal S7 upon detection of an incipient saturation of the resonant circuit inductance in such a way that it changes during a drive period from a first signal level, which does not influence the operation of the oscillator 6 to a second signal level. If the switched-on duration control signal assumes the second signal level, then an instantaneous drive period is directly ended or the oscillator is reset before the drive period predetermined by the fundamental frequency has elapsed. In this case, "ending a drive period" or "resetting the oscillator" should be understood to mean that the switch currently in the on state is turned off immediately—only taking account of signal propagation times—in the event of a change in the switched-on duration control signal S7 to the second signal level via the oscillator circuit 6 and the drive signal generating circuit 5. The presence of the second signal level of the switched-on duration control signal S7 thus leads to an increase in the frequency of the oscillator signal S6 and thus to a shortening of the drive period. In the example illustrated, in which the resonant circuit current I1 is evaluated during such a partial period of the drive period Tp in which the resonant circuit current flows through the half-bridge branch with the second switch T12, the switch which is immediately switched off in the event of a change in the switched-on duration control signal S7 to the second signal level is the second switch T12. For the purposes of the explanation below it should be assumed that the first signal level of the switched-on duration control signal S7 is a low level and the second signal level of the switched-on duration control signal S7 is a high level.

In the embodiment illustrated, the switched-on duration control signal S7 is fed to the other input of the OR gate 69, the output of which is connected to the reset input of the flip-flop 68. If the switched-on duration control signal S7 assumes a high level during a drive period, then the flip-flop 68 is reset, whereby the second switch T12 is turned off directly via the inverting output of the flip-flop 68 and the NOR gate 53 of the drive signal generating circuit 5, that is to say before the voltage V61 actually attains the upper threshold value, i.e., before the end of the drive period predetermined by the fundamental frequency has actually been reached. Such a scenario is illustrated in the right-hand part of FIG. 6 for some drive periods. The signal level of the switched-on duration control signal S7 at which the flip-flop 68 is reset and the second switch T12 is thus switched off is also referred to hereinafter as the switch-off level of the switched-on duration control signal S7. The temporal profile of the switched-on duration control signal S7 is likewise illustrated in FIG. 6.

If the flip-flop 68 is reset before the triangular voltage signal V61 actually attains the upper threshold value V67 of the oscillator circuit 6, this results in the shortening of not only the time duration of a low level of the clock signal S6 and hence the time duration of driving the second switch T12 in the on state, but also a subsequent discharge duration of the capacitor until the lower threshold value V66 is attained, which is directly apparent on the basis of the temporal profile of the voltage signal V61 in the right-hand part of FIG. 6; this results in the shortening of a subsequent time duration of a high level of the clock signal S6 and hence the time duration of driving the first switch T11 in the on state. In the lamp ballast illustrated in FIG. 6, the capacitor 61 of the oscillator circuit 6 fulfills two functions: firstly, the capacitor 61 in conjunction with the series circuits determines the frequency of the clock signal S6 during normal operation of the oscillator. In this case, the two current sources 62, 64 can be realized in one embodiment in such a way that they supply identical currents, whereby a symmetrical clock signal, that is to say a clock signal having equally long high levels and low levels, is attained during normal operation. The fundamental frequency of the clock signal S6 can be set via the two current sources 62, 64, for example. In this case, the current sources 62, 64 are controlled current sources to which the frequency signal FS is fed as setting signal. The fundamental frequency can also be set via the threshold values V66, V67. In this case, the threshold values V66, V67 or the difference between them, are dependent on the frequency signal FS. The difference between the two threshold values V66, V67 determines the signal swing of the voltage V61 across the capacitive storage element 61. If the signal swing is reduced, for example, then the frequency of the oscillator signal S6 increases.

In the oscillator 6 illustrated, the capacitor 61 additionally serves for time measurement, namely for determining a time duration between driving the first switch S11 in the off state and an incipient saturation of the resonant circuit inductance L2. This time duration is proportional to the difference between the capacitor voltage V61 at the instant of a switch-off owing to saturation and the lower threshold value V66. Assuming that the triangular signal is generated symmetrically, a discharge duration of the capacitor 61 from this value in the case of switch-off owing to saturation down to the lower threshold value V66 corresponds precisely to the preceding rise duration, whereby a symmetrical driving of the half-bridge switches T11, T12 is also achieved in the case of switch-off owing to saturation, that is to say that a switched-on duration of the second switch T12 before a switch-off owing to saturation corresponds at least approximately to a switched-on duration of the first switch T11 during the subsequent occurrence of the first switch T11 being driven in the on state.

It should be pointed out that the circuit explained with reference to FIG. 6 should be regarded merely as an example. Thus, in one embodiment the determination of the time duration between the turn-off of the first switch T11 and an incipient saturation of the resonant circuit inductance L1 can be determined in any other way, stored and used for subsequently driving the first switch T11 in the on state. There is the possibility, in one embodiment, of generating the clock signal using digital means. For this purpose, the capacitor could be realized for example by an incrementable and decrementable counter, and the signal generators could be realized by activatable clock generators for incrementing and decrementing the counter.

For the driving of the first and second switches T11, T12, provision is made for generating the drive signals S11, S12 in a manner dependent on the current profile of the current I1 of the series resonant circuit in such a way that one of the switches T11 or T12 remains switched on maximally for a predetermined time duration Tmax after a specific phase angle of the resonant circuit current I1 is present during the switched-on duration of the switch T11 or T12. Such a specific phase angle is attained for example when the resonant circuit current has attained a predetermined current value. This predetermined current value is zero, for example. A switch-off level of the switched-on duration control signal S7 is generated after the time duration Tmax has elapsed after the presence of a specific phase angle, for example a zero crossing. A present drive period is thus ended at the latest after the time duration Tmax has elapsed after the presence of the specific phase angle. If the time duration Tmax ends only after the drive period predetermined by the fundamental frequency has ended, then the switched-on duration control signal S7 has no influence on the oscillator frequency or on the driving of the two switches T11, T12. Such a scenario is illustrated in the left-hand part of FIG. 6. It is assumed for this illustration, by way of example, that the time duration Tmax begins in each case with a zero crossing of the resonant circuit current. The time duration Tmax here ends in each case only after the end of the drive period has already been attained, that is to say after the flip-flop 68 has already been reset.

Use is made here of the fact that the phase of the resonant circuit current I1 changes if the resonant circuit inductance starts to go to saturation. FIG. 6 illustrates in the right-hand part, by way of example, the temporal profile of the measurement signal Vs2 or of the resonant circuit current I1 during such an incipient saturation of the resonant circuit inductance L1. In this case, the zero crossings of the resonant circuit current I1 no longer lie in the center of the drive pulses—of the drive pulses of the second switch T12 in the example—but rather are shifted in the direction of a beginning of the drive pulses. The fact that after such zero crossings the second switch T12 remains switched on maximally for a predetermined switched-on duration Tmax ensures that very high resonant circuit currents in the case of an incipient saturation of the resonant circuit inductance L1 are avoided.

In order to detect those instants at which the resonant circuit current I1 attains a specific phase angle or a predetermined signal level, the switched-on duration controller 9 has a first detection circuit 91, which is designed to compare the current measurement signal Vs2 with a predetermined signal level. A detection signal S91 dependent on a comparison of the current measurement signal Vs2 with the predetermined signal level is available at the output of this first detection circuit. In the example illustrated, the first detection circuit has a comparator having an inverting input and a noninverting input, to which the current measurement signal Vs2 is fed as input signal. In the case of this detection circuit, the detection signal S91 is directly dependent on the sign of the current measurement signal Vs2 and has a first signal level in the case of a positive sign of the current measurement signal Vs2 and a second signal level in the case of a negative sign of the current measurement signal Vs2. In this case, the detection signal S91 is dependent on a comparison of the current measurement signal Vs2 with zero and directly contains information about zero crossings of the current measurement signal Vs2 or of the resonant circuit current I1. The detection circuit S91 is therefore also referred to hereinafter as zero crossing signal, and the first detection circuit 91 as zero crossing detector. In the example illustrated, the comparator is connected up in such a way that the first signal level—present in the case of a negative current measurement signal Vs2—of the detection signal is a high level and the second signal level—present in the case of a positive current measurement signal Vs2—of the detection signal is a low level.

The current measurement signal Vs2, for generating the detection signal S91, can, of course, also be compared with any other fixedly predetermined signal level in order to determine the phase angle of the resonant circuit current I1 or of the current measurement signal Vs2. For this purpose, the current measurement signal Vs2 has to be fed to one of the inputs of the comparator and a reference signal (not illustrated) with the predetermined (comparison) signal level has to be fed to the other of the inputs of the comparator.

The zero crossing signal S91 generated by the zero crossing detector 91 is fed together with the current measurement signal Vs2 to an evaluation circuit 90, which is designed to generate the switched-on duration control signal S7 in a manner dependent on the zero crossing signal S91 and the current measurement signal Vs2 in such a way that the switched-on duration control signal S7 assumes a switch-off level after the time duration Tmax has elapsed after a detected zero crossing of the current measurement signal S7. In this case, in a manner also explained, the time duration Tmax is dependent on the resonant circuit current I1, wherein the current measurement signal Vs2 is used as measurement variable for this resonant circuit current I1 in the example illustrated.

Figure 9:
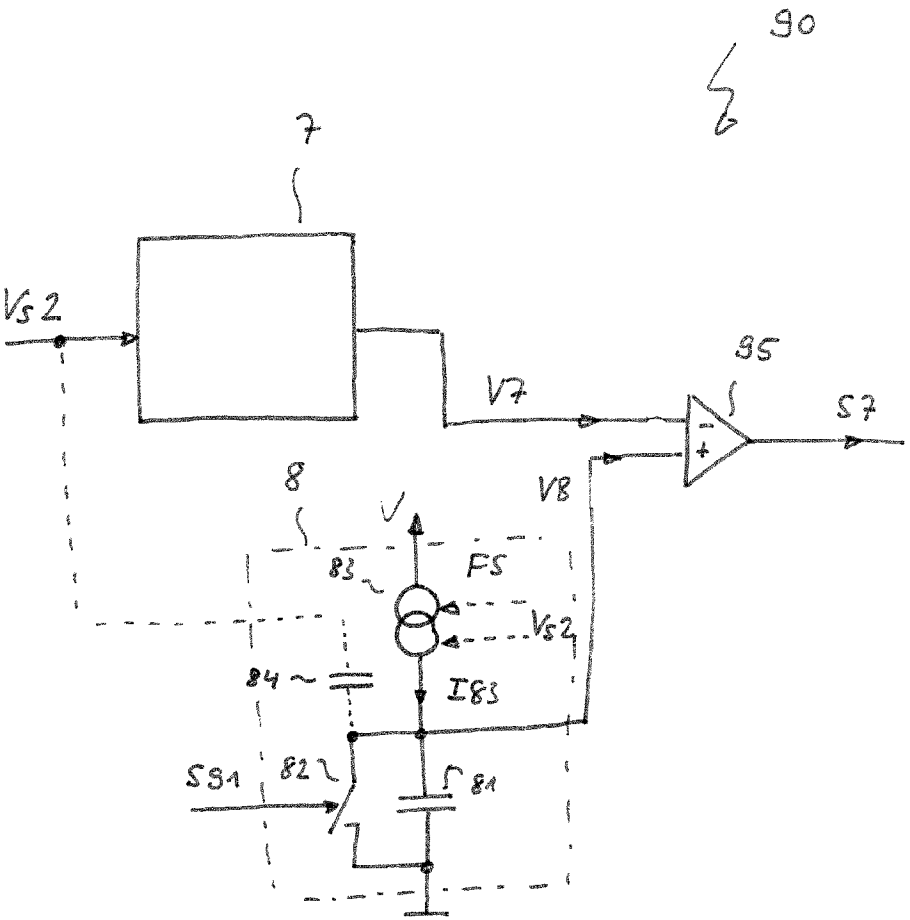
FIG. 9 illustrates one embodiment of an evaluation circuit of the switched-on duration control circuit.

One example of the evaluation circuit 90 is illustrated in FIG. 9. This evaluation circuit includes a time measurement arrangement 8, which generates a time measurement signal V8, a comparison value generating circuit 7, which generates a comparison value V7, and a comparator 95, which compares the time measurement signal V8 with the comparison value V7 and which generates the switched-on duration control signal S7 in a manner dependent on the result of the comparison.

In the embodiment illustrated, the time measurement arrangement 8 has a series circuit including a current source 83 and a capacitive storage element 81, such as e.g., a capacitor, and a switching element 82 connected in parallel with the capacitive storage element 81. In the case of this time measurement arrangement, the time measurement signal V8 corresponds to a voltage across the capacitive storage element 81. This time measurement arrangement 8 can be activated and deactivated via the switching element 82 connected in parallel with the capacitive storage element 81, the switching element being driven by the zero crossing detector 91. In the example illustrated, the time measurement arrangement is activated when the switching element 82 is opened, and is deactivated when the switching element 82 is closed. In the deactivated state, the capacitive storage element 82 is discharged via the switching element 82, such that the time measurement signal V8 is zero in the deactivated state. In the example explained with reference to FIGS. 5 and 7, the zero crossing detector 91 is connected up in such a way that after a zero crossing of the measurement voltage Vs2 after which the measurement voltage assumes a positive value with respect to the reference-ground potential GND, the zero crossing detector opens the switching element 82, and thus activates the time measurement arrangement 8. In this state, the voltage V8 across the capacitive storage element 81 rises in a manner dependent on a current supplied by the current source 83. In this case, the voltage V8 present across the capacitive storage element 81 directly represents a measure of the time which has elapsed since the activation, and thus since the zero crossing. If the voltage V8 across the capacitive storage element 81 attains the comparison value, then the switched-on duration control signal S7 assumes a switch-off level. The flip-flop (68 in FIG. 7) is thereby reset in order to switch off the lower switch T12 and thus to end the instantaneous drive period.

To afford a better understanding of the functioning of the evaluation circuit 90 illustrated in FIG. 9, a temporal profile of the voltage V8 across the capacitive storage element 81 of the time measurement arrangement 8 is illustrated in FIG. 6. As can be gathered from this figure, the voltage V8 across the capacitive storage element 81 rises after a zero crossing of the current measurement signal Vs2. If a value of the voltage V8 attains the comparison value V7, then the second switch T12 is switched off and the time measurement arrangement 8 is deactivated.

In a manner already explained, a charge state of the capacitor 61 of the oscillator 6 upon the resetting of the flip-flop 68 represents a measure of the switched-on duration of the lower switch T12. The charge state determines the subsequent switched-on duration of the first switch T11, wherein, given identically dimensioned current sources 62, 64 of the oscillator 6 the switched-on duration of the first switch T11 corresponds to the preceding switched-on duration of the second switch T12. A symmetrical driving of the switches T11, T12 of the half-bridge is thereby ensured even though the resonant circuit current I1 is only evaluated during a partial period of the drive period Tp of the half-bridge. In the embodiment explained, the resonant circuit current is evaluated during such a partial period during which the resonant circuit current I1 flows through the branch of the half-bridge with the second switching element T12.

It should be pointed out in this context that the current can, of course, also be evaluated during such partial periods during which the resonant circuit current I1 flows through the branch of the half-bridge with the first switching element T11. An evaluation of the current during the entire drive period is also possible. In this case, in a manner not illustrated, the time measurement arrangement 8 can be activated upon each zero crossing of the current measurement signal Vs2 and the oscillator 6 can be realized, in a manner not illustrated, such that the flip-flop 68 changes its state each time the comparison value V7 is attained by the time measurement signal V8. The above-described property of the oscillator 6 that the time duration from the switch-off of the first switch T11 to the saturation-dictated switch-off of the second switch T12 is equal to the subsequent time duration until the next switch-off of the first switch is not necessary in this case.

In the time profile illustrated in FIG. 6, the voltage V8 across the capacitive storage 81 rises linearly over time. This can be achieved by the current supplied by the current source 83 being constant. However, the current source 83 can also be realized in such a way that it supplies a temporally variable current. In this case, there is no longer a linear relationship between the time measurement signal V8 and the time duration that has elapsed since the zero crossing; however, the time measurement signal V8 is nevertheless dependent on the time duration.

One embodiment provides for modifying the time measurement arrangement and setting the current supplied by the current source 83 in a manner dependent on the current measurement value Vs2 (illustrated by dashed lines in FIG. 9). In this case, the voltage V8 across the capacitor 81 is proportional to the integral of the current supplied by the current source 83 over time, wherein the integral is in turn dependent on the current measurement signal Vs2. In this case, the switch T12 is turned off if the integral attains a value predetermined by the comparison value V7. In this case, use is made of the fact that the resonant circuit current increases with increasing proximity to the resonant frequency. By evaluating the integral of a current I83 dependent on the resonant circuit current after the zero crossing and switching off the second switch T12 if the integral attains a predetermined value, a limiting of the resonant circuit current is effected and a strong saturation of the resonant circuit inductance is thus prevented. Such a generation of the integrated current I83 in a manner dependent on the current measurement signal Vs2 can be expedient particularly when the resonant circuit current can be evaluated throughout and—as described above—the two switched-on durations are generated individually and independently of one another in a manner dependent on the instant of the current zero crossing.

Furthermore, there is the possibility of driving the current source of the time measurement arrangement by using the frequency signal FS. In this case, the charging current I83 supplied by the current source 83 is dependent on the frequency signal FS. In this case, the rise time of the time measurement signal V8 until this attains a specific comparison value V7, or the gradient of the time measurement signal V8 over time, is in a fixed relation with respect to the drive period in the normal operating state of the oscillator. The signal range/variation range of the comparison value V7 that is necessary for an ignition voltage control is thereby independent of the resonant frequency of the connected resonant circuit since the rise time of the time measurement signal V8 is virtually normalized to the resonant frequency.

The comparison signal V7 is illustrated as a constant signal in FIG. 6 merely for explanation purposes. In actual fact, this comparison signal V7 is temporally variable and dependent on the temporal profile of the resonant circuit current I1. In the case of the lamp ballast explained, use is made of the fact that the rate of rise of the current measurement signal Vs2 after the zero crossing is dependent on the oscillation amplitude, that is to say the amplitude of the voltage present across the lamp. The rate of rise greatly rises if the excitation frequency of the resonant circuit varies in the direction of the resonant frequency of the resonant circuit, that is to say if the oscillation amplitude greatly rises. In the case of an incipient saturation, too, the rate of rise of the current in the vicinity of the current zero crossing is still proportional to the oscillation amplitude, whereas the further profile of the resonant circuit current, owing to saturation, may already be distorted to an extent such that solely the amplitude of the resonant circuit current or of the current measurement signal Vs2 does not permit a statement about this voltage of the oscillation. By evaluating the resonant circuit current after a zero crossing, use is made virtually of that part of the current signal Vs2 which is not distorted by the saturation for the voltage measurement, that is to say for the measurement of the oscillation amplitude.

The method provides for decreasing the comparison value V7 if the current measurement signal Vs2 indicates that a sought voltage amplitude of the oscillation or a sought current gradient of the resonant circuit current has been attained. A shortening of the maximum switched-on duration Tmax is achieved in this way. This shortening of the maximum switched-on duration Tmax can lead to a shortening of the switched-on duration of the second switch T12 and thus subsequently also to a shortening of the switched-on duration of the first switch T11. This is the case particularly when—as illustrated in FIG. 6—upon an incipient saturation of the resonant circuit inductance the instant of the zero crossing is shifted in such a way that after a zero crossing the maximum time duration Tmax has already elapsed before the end of the drive period as predetermined by the fundamental frequency has actually been reached.

Figure 10:
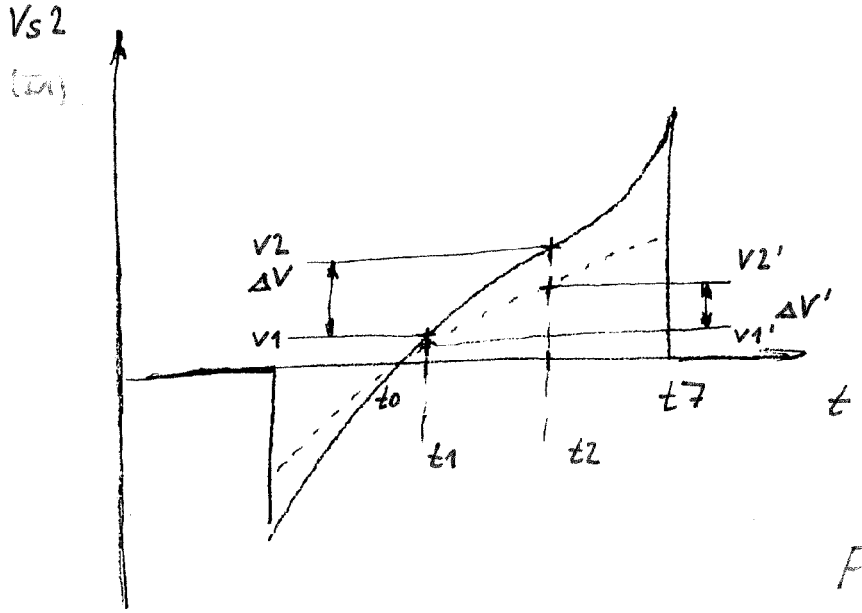
FIG. 10 illustrates one embodiment of a functioning of a comparison value generating circuit present in the evaluation circuit on the basis of signal profiles.

The comparison value generating circuit 7 is designed to evaluate the current measurement signal Vs2 at two different instants during a partial period and to determine the comparison signal V7 in a manner dependent on the evaluation results thereby obtained. In this context, a "partial period" should be understood generally to mean a time segment of the drive period Tp during which the current flows through one of the two half-bridge branches. For the purposes of the following explanation it should be assumed that such an evaluation of the current measurement signal Vs2 is effected during such a partial period during which the resonant circuit current flows through the half-bridge branch with the second switch T12. To afford a better understanding, FIG. 10 illustrates the temporal profile of the current measurement signal Vs2 during such a partial period. FIG. 10 illustrates the profile of the resonant circuit current I1 or current measurement signal for two different operating states of the lamp ballast: a first operating state (solid line), in the case of which the current measurement signal Vs2, after a zero crossing, has a first gradient; and a second operating state (dashed line), in the case of which the current measurement signal Vs2, after a zero crossing, has a second gradient, which is smaller than the first gradient. The larger first gradient in comparison with the second gradient indicates a higher amplitude of the resonant circuit voltage in the first operating state than in the second operating state. It is assumed in the example illustrated that the resonant circuit inductance, in the first operating state, is already being operated in the region of its saturation. As a result, the temporal profile of the resonant circuit current I1 is distorted toward the end of the switched-on duration of the second switch T12 owing to saturation such that an evaluation of the amplitude of the resonant circuit current I1 would not permit a reliable statement about the amplitude of the resonant circuit voltage, or of the voltage across the lamp. These signal profiles differ during the illustrated partial period with regard to their gradient and with regard to their maximum amplitude values.

The current measurement signal Vs2 is evaluated in such a way that a temporal change in the current measurement signal Vs2 from a first evaluation instant t1 to a second evaluation instant t2 is determined. In this case, a temporal change in the current measurement signal Vs2 from the first evaluation instant t1 to a second evaluation instant t2 should be understood to mean a change in the amplitude of the current measurement signal Vs2 relative to the time duration between the first and second evaluation instants, that is to say that the following holds true:

$$\frac{\Delta Vs2}{\Delta t} = \frac{|V2 - V1|}{|t2 - t1|}. \quad (1)$$

In this case, ΔVs2/Δt designates the temporal change in the current measurement signal Vs2 between the evaluation instants. V1 designates the amplitude value of the current measurement signal Vs2 at the first evaluation instant t1, and V2 designates the amplitude value of the current measurement signal Vs2 at the second evaluation instant t2. Δt designates the temporal spacing between the evaluation instants t1, t2.

Figure 12:
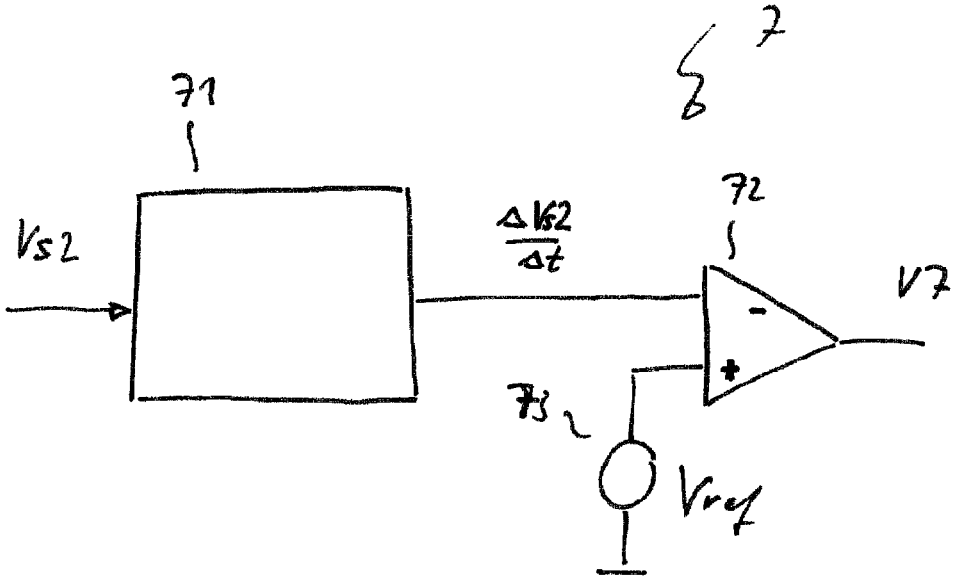
FIG. 12 illustrates one embodiment of the comparison value generating circuit.

For generating the comparison value signal V7, provision is additionally made for comparing the change value ΔVs2/Δt determined during each partial period with a reference value and for generating the comparison signal V7 in such a way that it is dependent on a difference between the change value ΔVs2/Δt and the reference value. One example of a comparison value generating circuit 7 having such a functionality is illustrated in FIG. 12. This comparison value generating circuit 7 has a sampling circuit 71, to which the current measurement signal Vs2 is fed and which generates a change value ΔVs2/Δt. The change value ΔVs2/Δt is fed together with a reference value Vref to a controller 72. The controller 72 is a proportional-integral controller, for example, which determines a difference between the change value ΔVs2/Δt and the reference value Vref and which generates the comparison signal V7 in such a way that it has both a proportional component and an integral component. In this case, the proportional component is dependent on an instantaneous difference between the present change value ΔVs2/Δt and the reference value Vref. The integral component is dependent on differences between change values and the reference value which were determined for a number of previous drive periods.

The change value ΔVs2/Δt can be determined by the sampling circuit 71 in various ways. Referring to FIG. 10, there is the possibility of fixedly predetermining the temporal spacing Δt between the sampling instants t1, t2. In this case, the magnitude of the difference $$\Delta V = |V2 - V1| \quad (2)$$

between the amplitude values V1, V2 determined at the sampling instants t1, t2 directly represents a measure of the change value. In this case, the magnitude of the differences represents a first difference value, from which a second difference value is determined using the reference value Vref in a manner explained. In this case, the comparison value V7 is dependent on a number of second difference values which were determined during a plurality of drive periods. In the case of a steep rise in the current measurement signal Vs2 such as occurs in the case of an incipient saturation of the resonant circuit inductance L1, a larger change value ΔV is obtained in this case than in the case of a less steep rise in the current measurement signal Vs2, such as occurs when the amplitude oscillation is still smaller.

The temporal spacing of the sampling instants t1, t2 is chosen for example such that it is smaller than the time duration between the zero crossing and the instant at which the switch-off level of the switched-on duration control signal S7 is generated. This instant is designated by t7 in FIG. 10. In FIG. 10, t0 designates the instant of a zero crossing of the voltage measurement signal Vs2. The temporal spacing between the sampling instants t1, t2 can be chosen in one embodiment such that it approximately corresponds to, or is less than, half of the temporal spacing between the zero crossing t0 and the instant t7. The sampling instants t1, t2 can both lie after the zero crossing t0, in which case the first sampling instant t1 can also coincide with the instant t0 of the zero crossing. Furthermore, the first sampling instant t1 could also lie temporally before the zero crossing. The first sampling instant t1 can for example be defined by using the instant t0 of the zero crossing and be chosen such that it always lies at a fixed temporal spacing, including zero, with respect to the zero crossing instant. However, the first sampling instant t1 can also be defined by a comparison of the current measurement signal Vs2 with a comparison value. In this case, the first sampling instant t1 is present when the current measurement signal Vs2 attains the comparison value. In both cases, the temporal position of the second sampling instant t2 is predetermined by the temporal position of the first sampling instant t1 and the desired temporal spacing Δt between the sampling instants t1, t2.

The sampling instants lie in one embodiment sufficiently close to the zero crossing instant such that it is ensured that there is still no saturation of the resonant circuit inductance at the evaluation instants, that is to say that the resonant circuit current present at the evaluation instants is still smaller than a current at which a saturation of the resonant circuit inductance begins. It is ensured in this way that an evaluation of the resonant circuit current for determining the oscillation amplitude is effected at a time at which there is still no saturation-dictated distortion of the current profile.

Figure 11:
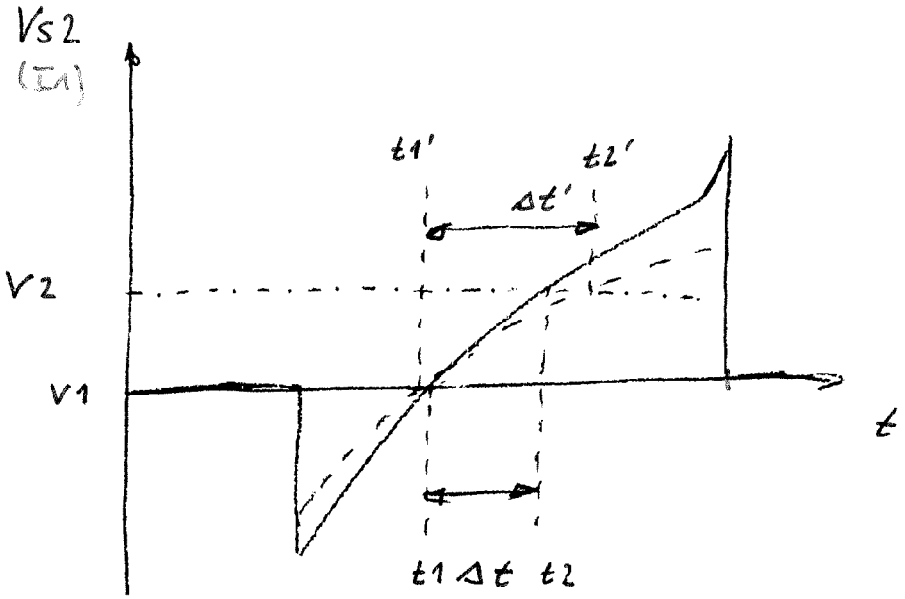
FIG. 11 illustrates one embodiment of a functioning of a comparison value generating circuit present in the evaluation circuit on the basis of signal profiles.

Referring to FIG. 11, in a further example for determining the change value ΔVs2/Δt, provision is made for predetermining first and second threshold values V1, V2 and determining a temporal spacing Δt and Δt' between two instants at which the current measurement signal Vs2 respectively attains the threshold values. In FIG. 12, t1 and t2 designate first and second sampling instants at which the current measurement signal Vs2 attains the threshold values V1, V2 if the steep signal profile illustrated by a solid line is present, and t1', t2' designate the sampling instants at which the threshold values V1, V2 are attained if the shallower signal profile is present. In the case of such a procedure, the reciprocal of the temporal difference Δt, Δt' taking account of the difference between the threshold values V1, V2 directly represents a measure of the change value ΔVs2/Δt. The first and second threshold values V1, V2 can both be positive. Furthermore, the first threshold value V1 can also be negative and the second threshold value V2 positive.

The generation of the change value ΔVs2/Δt and the generation of the comparison signal V7 are coordinated with one another in such a way that the comparison value V7 becomes all the smaller, the larger the change value ΔVs2/Δt becomes in comparison with the reference value Vref. A large change value ΔVs2/Δt indicates a steep signal profile of the current measurement signal Vs2; in this case, the maximum time duration Tmax during which the second switch T12 still remains switched on after the zero crossing of the current measurement signal Vs2 is to be reduced in order to reliably prevent very high current values of the resonant circuit current I1 from being attained.

In the case of the explained generation of the comparison signal V7 using a sampling circuit 71 and a controller 72, changes in the temporal profile of the current measurement signal Vs2 affect the generation of the comparison signal V7 only in time-delayed fashion with a delay time of one period duration. In order, at the beginning of saturation operation of the resonant circuit inductance L2, directly to achieve a shortening of the drive period Tp and thus an increase in the switching frequency, in one example provision is made for generating the time measurement signal V8 in a manner dependent on the resonant circuit current I1 in such a way that the time measurement signal V8 rises more rapidly at a high resonant circuit current I1, such that with the comparison value V7 initially unchanged, the comparison value V7 is nevertheless attained earlier.

Referring to FIG. 9, for this purpose there is the possibility, for example, of feeding the current measurement signal Vs2 to the capacitive storage element 81 of the time measurement element 80 via a capacitor 84. In this case, the current measurement signal Vs2 provides for an offset of the time measurement signal V8 which is all the larger, the larger the amplitude of the current measurement signal Vs2. A steep rise of the current measurement signal Vs2 and associated high amplitudes of the current measurement signal in this way directly affect a shortening of the time duration Tmax between a zero crossing of the current measurement signal Vs2 and the switch-off of the second switch T12.

Figure 13:
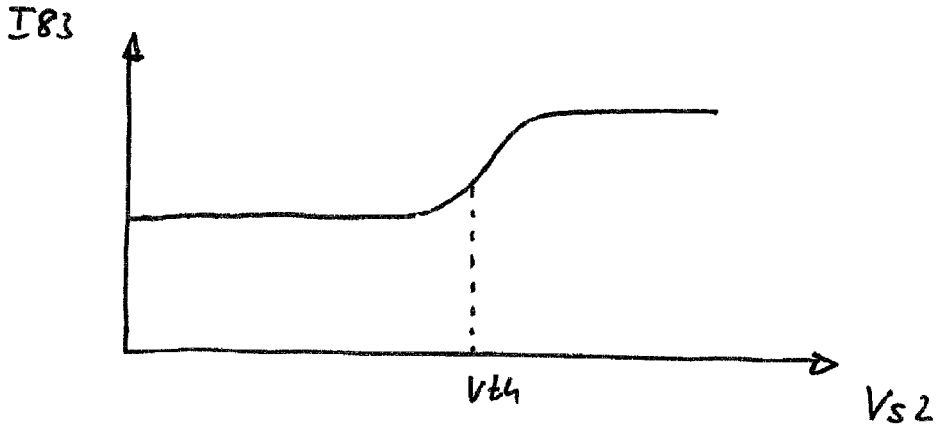
FIG. 13 illustrates the functioning of a current source of a time measurement arrangement of the switched-on duration control circuit.

As an alternative or in addition to the provision of such a coupling capacitor 84, there is the possibility of realizing the current source 83 of the time measurement arrangement 8 in such a way that this generates the charging current I83 for the capacitive storage element 81 in such a way that the charging current 83 rises if the current measurement signal Vs2 exceeds a predetermined threshold value. Such a dependence of the charging current I83 on the current measurement signal Vs2 is illustrated by way of example in FIG. 13. In FIG. 13, Vth designates the threshold value of the current measurement signal Vs2 from which the charging current I83 rises.

Figure 14:
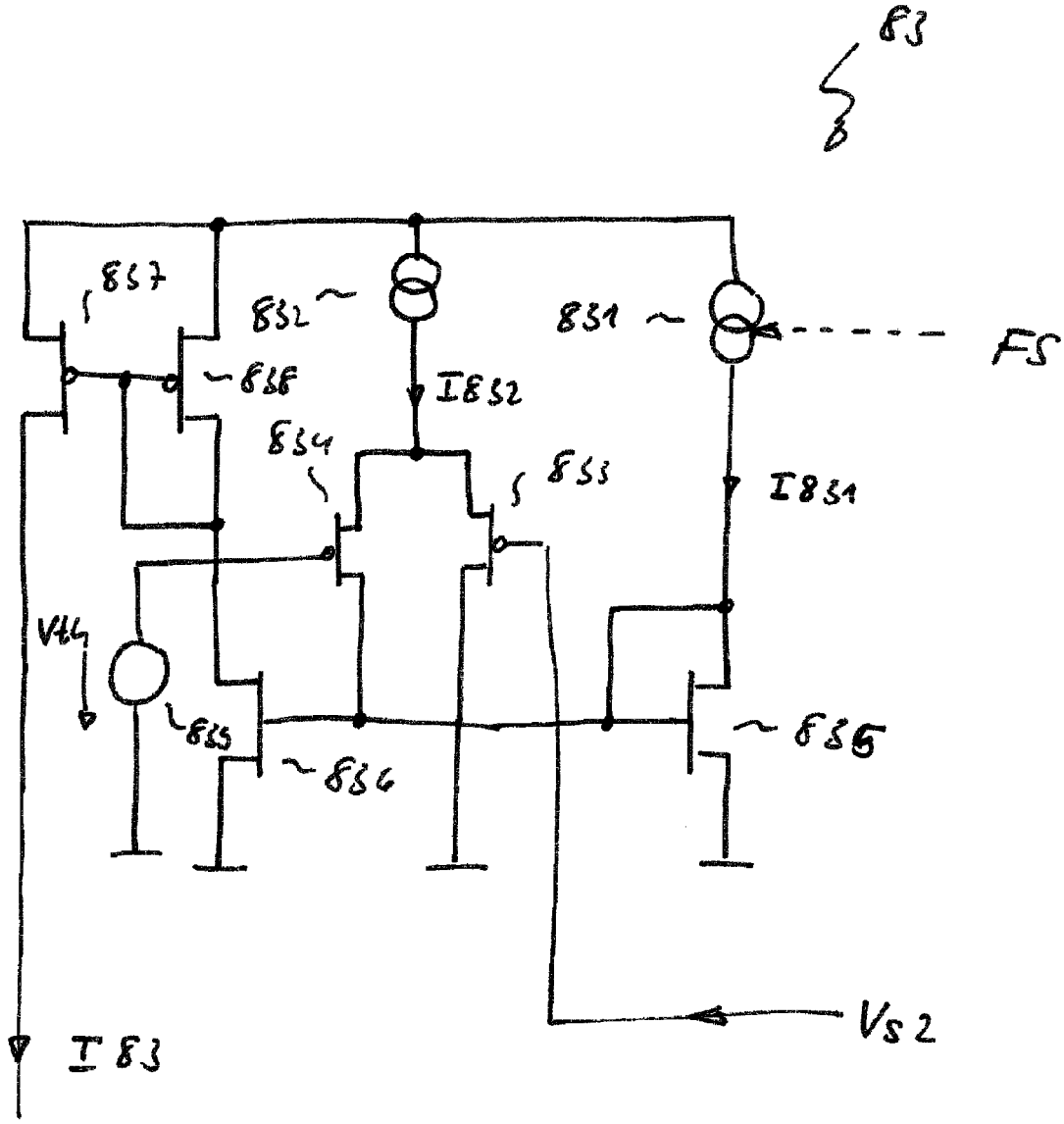
FIG. 14 illustrates one embodiment of this current source.

In one embodiment of a circuitry realization of a controlled current source 83 having the functionality explained with reference to FIG. 13 is illustrated in FIG. 14. This controlled current source 83 has a first current source 831 and a second current source 832. The first current source 831 determines the "fundamental current" of the controlled current source 83, which flows independently of the current measurement signal Vs2. This first current source 831 can be a current source controlled by the frequency signal FS, the fundamental current being dependent on the frequency signal FS in this case. The controlled current source 83 has a current mirror arrangement including two current mirrors each having an input transistor and an output transistor. These current mirrors are connected up in such a way that they map a "fundamental current" I831 provided by the first current source 831 onto the charging current I83 provided by the controlled current source 83. For this purpose, the first current source 831 is connected in series with an input transistor 835 of the first current mirror 835, 836. The charging current I83 is provided by an output transistor 837 of the second current mirror 837, 838. An output transistor 836 of the first current mirror is connected in series with an input transistor 838 of the second current mirror.

The controlled current source 83 additionally has a comparator 833, 834, which compares the current measurement signal Vs2 with the threshold value Vth and which, depending on this comparison result, adds to the fundamental current I831 supplied by the first current source 831 a part of the current I832 supplied by the second current source 832, which part is dependent on the comparison. The comparator has two transistors 833, 834, of which a first 833 is driven by the current measurement signal Vs2 and of which a second 834 is driven by a voltage source 839 that provides the threshold value Vth. In this case, the load path of the first transistor 833 is connected between the second current source 832 and a reference-ground potential, while the load path of the second transistor 834 is connected between the second current source 832 and the node common to the two transistors 835, 836 of the first current mirror. In the example illustrated, the two transistors 833, 834 of the comparator circuit are realized as p-channel transistors. If the current measurement signal Vs2 is less than the threshold value Vth, then the first transistor 833 of the comparator circuit conducts more than the second transistor 834, with the result that a significant part of the second current I832 flows away via the first transistor 833. If the current measurement signal Vs2 exceeds the threshold value Vth, then a significant part of the current I832 flows via the second transistor 834 and in this way is fed into the first current mirror and thus contributes to an increase in the charging current I83.

Figure 15:
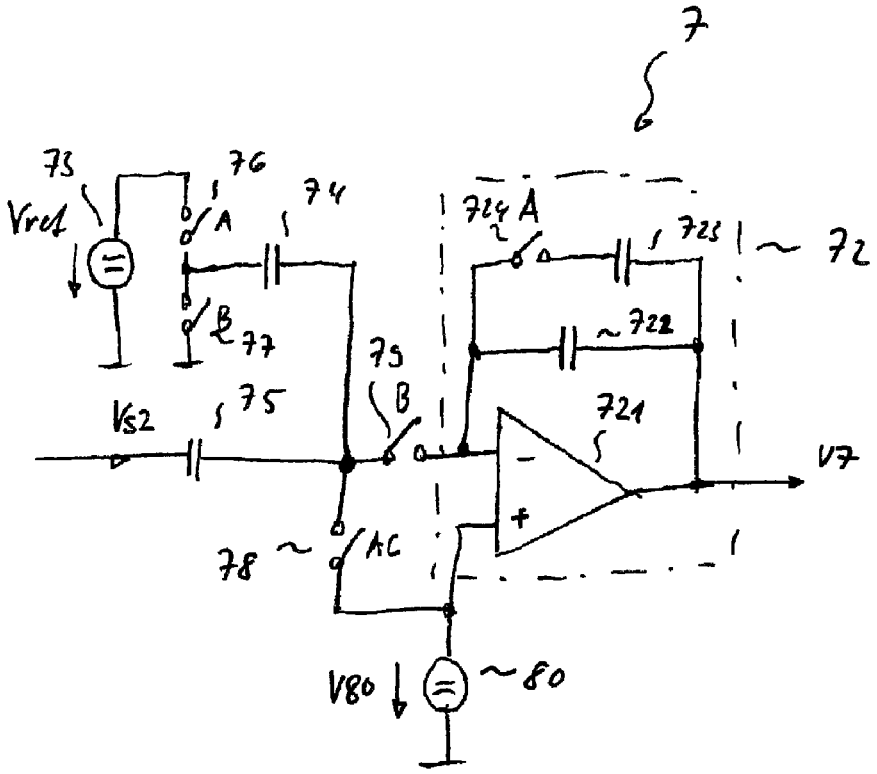
FIG. 15 illustrates one embodiment of the comparison value generating circuit.

A comparison value generating circuit 7 which is simple and can be realized cost-effectively, and which generates the comparison value V7 in a manner dependent on the change value in the manner explained, is illustrated in FIG. 15. The functioning of this comparison value generating circuit 7 becomes clear on the basis of temporal profiles of the current measurement signal Vs2 and of the comparison value V7 which are illustrated by way of example in FIG. 16.

The comparison value generating circuit 7 has the already explained controller 72 having an inverting input and a noninverting input and an output, at which the comparison value V7 is available. In the example illustrated, the controller 72 has a control amplifier 721 and also two capacitances 722, 723, which are connected in parallel with one another between the inverting input and the output of the control amplifier 721. In this case, a switch 724 is connected in series with one 723 of the two capacitances 722, 723. A voltage source 80 is connected between the noninverting input of the control amplifier 721 and a reference-ground potential GND, which voltage source provides a constant voltage and serves for setting the operating point of the controller 72. The control amplifier 721 is embodied as an operational amplifier and is in this case connected up to the capacitance 722 as an integrator that integrates the charge available at its inverting input.

The comparison value generating circuit 7 additionally has a first capacitance 74 and a second capacitance 75, which each have first and second connections and the second connections of which are connected to a common circuit node. This common circuit node is connected via a first switch 78 to the noninverting input and via a second switch 79 to the inverting input of the controller 72. The first connection of the first capacitance 74 can optionally be connected to the reference voltage source 73, which provides the reference signal Vref, or reference-ground potential GND via two further switches: a third switch 76 and a fourth switch 77. The current measurement signal Vs2 is fed to the first connection of the second capacitance 75.

During a drive period, the comparison value generating circuit 7 has three different operating states, which are designated by A, B and C. The individual switches of the comparison value generating circuit 7 are driven in the on state or in the off state during these operating states. In order to afford a better understanding, FIG. 15 indicates alongside the respective switches the operating states during which the individual switches are driven in the on state.

A first operating state or a first operating phase A extends up to the first evaluation instant t1, which for example coincides with the zero crossing instant. During this operating phase, the first switch 78 and the third switch 76, which connects the first capacitance 74 to the reference voltage source 73, are closed. The first capacitance 74 is thereby charged to a voltage which corresponds to the reference voltage Vref minus the operating point voltage V80 supplied by the voltage source 80. During this operating phase, a voltage corresponding to the current measurement signal Vs2 minus the operating point voltage V80 is present across the second capacitance 75.

The second operating state or the second operating phase B begins with the first evaluation instant t1 and ends with the second evaluation instant t2. At the instant t1, the first switch 78 is opened and the second switch 79 is closed. In addition, the third switch 76, which connects the first capacitance 74 to the reference voltage source 73, is opened, and the fourth switch 77, which connects the first capacitance 74 to reference-ground potential GND, is closed. The first evaluation instant corresponds for example to the zero crossing instant, this being taken as a basis for the following explanation. For the following explanation of the processes during the second operating phase B it should be assumed that the current measurement signal Vs2 changes slowly after the zero crossing instant relative to the duration of the also explained switching processes of the switches 76-79 and relative to the duration of a settling process—yet to be explained—of the operational amplifier 721, with the result that the influence of a change in the current measurement signal Vs2 at the beginning of the operating phase B can initially be disregarded.

If the second switch 79 is closed at the beginning of the second operating phase, then the integrator 721, 722 integrates all the charges fed in to its inverting input. Shortly before the first sampling instant t1, that is to say shortly before the closing of the second switch 79, the voltage across the second switch 79 is zero. This is due to the fact that the first switch 78, which is closed during the first operating phase, constrains the potential of the common node of the first and second capacitances 74 and 75 to the value of the operating point voltage V80 and that the differential input voltage of the control amplifier 721, which is realized as an operational amplifier, is zero when the control loop is closed. If, at the first sampling instant t1, the first switch 78 is opened and the second switch 79 is closed, as a result of this process alone no charge flows toward the inverting input or away from the inverting input. At the same time, however, the third switch 76 is opened and the fourth switch 77 is closed. As a result of this process, the potential at the common node of the first capacitance 74 and of the first and second switches 76, 77 changes by a voltage corresponding to the reference voltage Vref. Since the operational amplifier 721 reestablishes the voltage balancing at its inputs on account of the closed control loop, the potential at the node common to the first capacitance 74 and second switch 79 is identical before the beginning of the second operating phase, that is to say before the first sampling instant t1, and after the elapsing of a settling time of the operational amplifier 721 after the beginning of the second operating phase. In this case, the electrical charge stored in the first capacitance 74 changes by a value corresponding to the product of the capacitance value of the first capacitance and the reference value Vref. In the course of the settling process, this quantity of charge flows away from the inverting input of the operational amplifier 721 and thus from the integrator input. In this case, the voltage at the output of the integrator changes by a voltage difference corresponding to the quotient of the quantity of charge that has flowed away and the capacitance value of the capacitance Z2 of the controller 7. This change can be seen in the temporal profile in accordance with FIG. 16 as a rise in the comparison value V7 directly after the first sampling instant t1.

In the further temporal course of the second operating phase, the current measurement signal Vs2 slowly rises further. One connection of the second capacitance 75 is fixedly at the value of the current measurement signal Vs2, while the other connection is connected via the still closed second switch 79 to the integrator input, that is to say the noninverting input of the control amplifier 721, and is at a constant potential corresponding to the operating point voltage V80. In the further course, a change in the voltage across the second capacitance 75 corresponds to a temporal change in the current measurement signal Vs2. In this case, overall a charge corresponding to the voltage change in the current measurement signal Vs2 starting from the instant t1 multiplied by a capacitance value C75 of the second capacitance 75 flows to the integrator input.

At the second sampling instant t2, the second switch 79 is opened again and the first switch 78 is closed. Starting from this instant, therefore, no further charge can flow from the second capacitance 75 toward the integrator input or away from the latter, the integrator state is as it were frozen. The voltage change at the integrator output from an instant after the first sampling instant t1 at which the operational amplifier 721 has settled until the second sampling instant t2 corresponds to the voltage change in the current measurement signal Vs2 within this time negatively multiplied by the capacitance ratio C75/C722 of the capacitance values C75 and C722 of the second capacitance 75 and, respectively, the capacitance 722 of the integrator. From the instant t1 until the settling of the operational amplifier, the integrator output changes by the value of the reference voltage Vref multiplied by the capacitance value C74/C722 of the capacitance values C74 and C722 of the first capacitance 74 and the capacitance C722 of the integrator. Thus, a voltage change ΔV7 at the integrator output from the first sampling instant t1 until the second sampling instant t2 amounts overall to $$\Delta V7 = \frac{Vref \cdot C74 - \Delta V \cdot C75}{C722} \tag{3}$$

If the following holds true for the change ΔV in the current measurement signal Vs2 within the evaluation time period Δt lying between the two sampling instants:

$$\Delta V = \frac{Vref \cdot C74}{C75} \tag{4}$$

then there is no change in the comparison value V7 relative to the sampling instants t1, t2. The value given by Vref·C74/C75 in this case represents a reference value with which the change ΔV in the current measurement signal Vs2 is compared in order to generate the comparison signal V7. If the change ΔV in the current measurement signal Vs2 is less than this reference value, then the comparison signal V7 rises relative to the sampling instants; the time profile for this case is illustrated as a dashed line in FIG. 16. Correspondingly, the comparison signal V7 becomes smaller relative to the sampling instants if the change ΔV in the current measurement signal Vs2 is greater than the reference value; the time profile for this case is illustrated as a solid line in FIG. 17.

The comparison signal V7 available at the output of the integrator remains frozen after the end of the second operating phase during the third operating phase C until the switch-off instant t7 and is used in accordance with the explanations above for generating the switched-on duration control signal S7.

The third operating phase can end at the instant t7 or later. This third operating phase is followed by a new first operating phase A. When the operating phase transition from the third to the first phase takes place is irrelevant; it should take place during the switched-off duration of the switch T12. In the operating phase A, a further capacitance 723 is connected in parallel with the capacitance 722 of the integrator. The capacitance value of the capacitance 723 is for example approximately three to ten times the capacitance value of the capacitance 722. The capacitance 723 is charged during the first operating phase A to a voltage value corresponding to the difference between the comparison signal V7 at the output of the integrator and the operating point voltage V80. In the succeeding operating phase C, a voltage corresponding to the difference between the "new" comparison signal V7 and the operating point voltage V80 is present across the capacitance 722 of the integrator. As a result of the parallel connection during the subsequent operating phase A, the voltages across both capacitances become matched to a value corresponding to an average value of the voltage during the preceding operating phase A and the directly preceding operating phase C, weighted according to the capacitance ratio of the capacitances 722 and 723.

The deviations of the temporal change ΔV in the current measurement signal from the reference value Vref·C74/C75 are summed for all preceding cycles in the form of the charge of the capacitance 723. The charge stored in this capacitance 723 thus represents the integral component (I component) of the signal present at the output of the controller. The pure I component can be tapped off at the integrator output V7 during the operating phases A. Since the charge of the capacitance 722 is reset to the I component during each operating phase A, but until the operating phase C additionally experiences a charge change proportional to the deviation of the temporal ΔV from the reference value Vref·C74/C75 of the respective operating cycle, the capacitance 722 contains during the operating phase C a charge that differs from the I component by a proportional component (P component). The ratio of I component and P component can be selected by using the capacitance ratio of the capacitances 722 and 723. The sum of I component and P component of the controller output voltage can be tapped off as comparison signal V7 during the third operating phases C. Expressed in a highly simplified way, the capacitance ratio of the capacitances is a measure of how often the capacitance 722 has to be charged during the operating phase B to a voltage that is different with respect to the capacitance 723, and subsequently has to be discharged into the capacitance 723 during the operating phase A until the voltage at the capacitance 723 changes by as much as the voltage of the capacitance 722 changes during each operating phase B.

Figure 16:
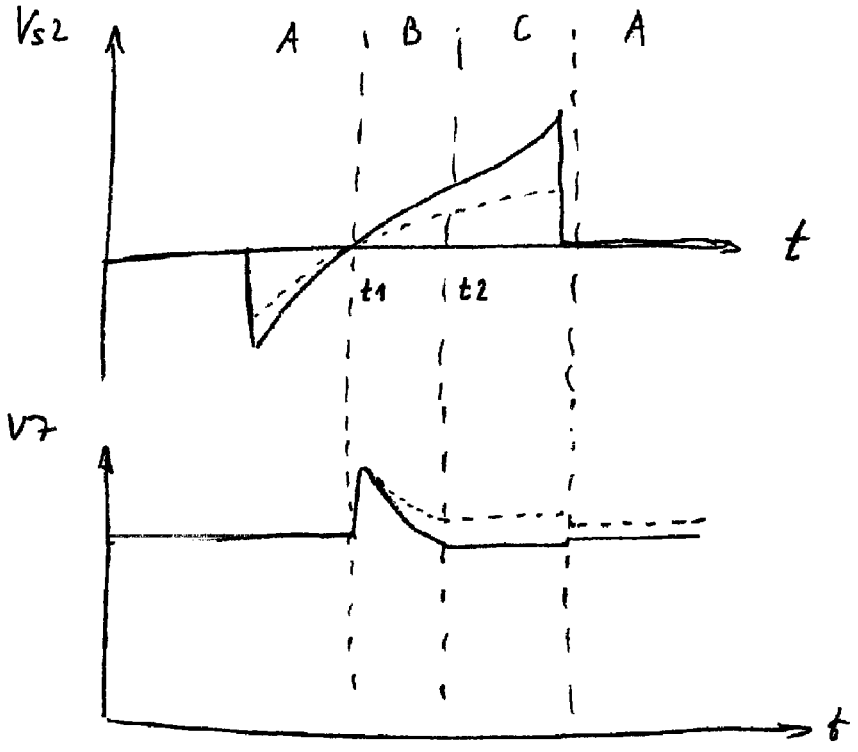
FIG. 16 illustrates the functioning of this comparison value generating circuit.

Referring to FIG. 16, although the comparison signal can be subjected to considerable fluctuations in one embodiment during the second operating phase, the comparison signal V7 is subjected to no fluctuations during the operating phase C, during which the comparison signal V7 is used for generating the switched-on duration control signal S7, and has during this phase in one embodiment the above-explained desired dependence on the temporal change ΔV in the current measurement signal Vs2 between the evaluation instants t1, t2.

The individual switches are controlled by a sequence controller (not illustrated in greater detail). By way of example, information about the instant of the zero crossing is fed to the sequence controller. Information about the evaluation duration Δt=t2−t1 is for example fixedly programmed in the sequence controller, such that the start and end of the second operating phase B and hence the end of the first and the start of the third operating phase are fixed taking account of the zero crossing instant. The sequence controller additionally requires information about the switch-off instant at which the second switch T12 is switched off, and is designed for example to choose the end of the third operating phase—and hence the start of the subsequent first operating phase—in such a way that it lies a predetermined time duration after the switch-off instant.

In the case of the ballast illustrated, a reduction of the comparison voltage V7 brings about a shortening of the maximum switched-on duration, which, particularly when the resonant circuit inductance is operated in the region of its saturation, can lead to an increase in the excitation frequency since the switched-on duration of the lower switch T12 is shortened starting from the zero crossing. The oscillation amplitude of Vs2 decreases as a result. Conversely, a raising of the comparison voltage V7 brings about a lengthening of the maximum switched-on duration Tmax, which can lead to a reduction of the excitation frequency and hence to an increase in the oscillation amplitude for as long as the oscillator is in the saturation operating state. In the normal operating state, by contrast, the excitation frequency and the oscillation amplitude are independent of the comparison voltage V7 since the end of the switched-on duration of the second switch is already attained in this case before the oscillator is actually reset by the switched-on duration control signal S7.

Referring to the explanations above, the comparison signal V7 influences the switching frequency of the half-bridge only when the time measurement signal V8 attains the value of the comparison signal V7, before the end of the switched-on duration—predetermined by the fundamental frequency of the oscillator 6—of the second switch T12 has actually been reached. In order to ensure that the drive circuit reacts rapidly upon an incipient saturation of the resonant circuit inductance, that is to say that the comparison signal V7 is rapidly decreased, in order effectively to achieve a shortening of the drive period, one embodiment provides for already generating the comparison signal V7 during the time duration during which the frequency signal FS is decreased for the ignition of the lamp such that the switched-on duration predetermined by the switched-on duration controller 9 approximately corresponds to the switched-on duration predetermined by the fundamental frequency of the oscillator 6. This is tantamount to generating the comparison signal V7 such that the time measurement signal V8 attains the comparison signal V7 at the same instant at which the voltage across the capacitor 61 of the oscillator 6 attains the upper comparison value V67. In this case, the comparison value signal V7 initially has no influence on the drive frequency. However, if the resonant circuit inductance starts to go to saturation, and if the resonant circuit current rises rapidly, then the comparison value V7 can be rapidly reduced further proceeding from the "settled value" established previously, in order thereby more effectively to limit the switched-on durations of the two switches of the half-bridge and hence initially to raise the drive frequency again.

The functioning of the ballast explained is explained below with reference to FIG. 17, in which the frequency signal FS, the current measurement signal Vs2, the comparison value V7 and the excitation frequency f=1/Tp are illustrated in each case against time. In order to achieve an ignition of the lamp, the frequency signal FS is generated by a central control circuit (not illustrated in greater detail) in such a way that the frequency signal FS slowly approximates to the resonant frequency. In the example illustrated, such an approximation to the resonant frequency is effected by a stepwise (staircase-type) reduction of the frequency signal FS. The maximum switched-on duration Tmax—determined by the switched-on duration control circuit 9—starting from the current zero crossing is in this case initially longer than the switched-on duration set by the oscillator 6, and during this operating phase the excitation frequency is as a result initially dependent on the frequency signal FS and not on the comparison signal V7. The frequency f=1/Tp decreases owing to the reduction of the frequency signal FS. The frequency 1/Tp lies for example in the region of a few ten kHz.

The amplitude of the current measurement signal Vs2 initially rises relatively slowly during the reduction of the frequency f. The comparison signal V7 can be tracked during this phase in such a way that the oscillator 6 is operated in the normal operating state but at the limit with respect to the saturation operating state. The comparison signal V7 is therefore set in such a way that a signal pulse of the switched-on duration control signal S7 (cf. FIGS. 6 and 7) is generated at the same instant or shortly after an instant at which the oscillator 6 is reset anyway owing to the frequency signal FS. The comparison signal V7 rises slowly in this case.

Figure 17:
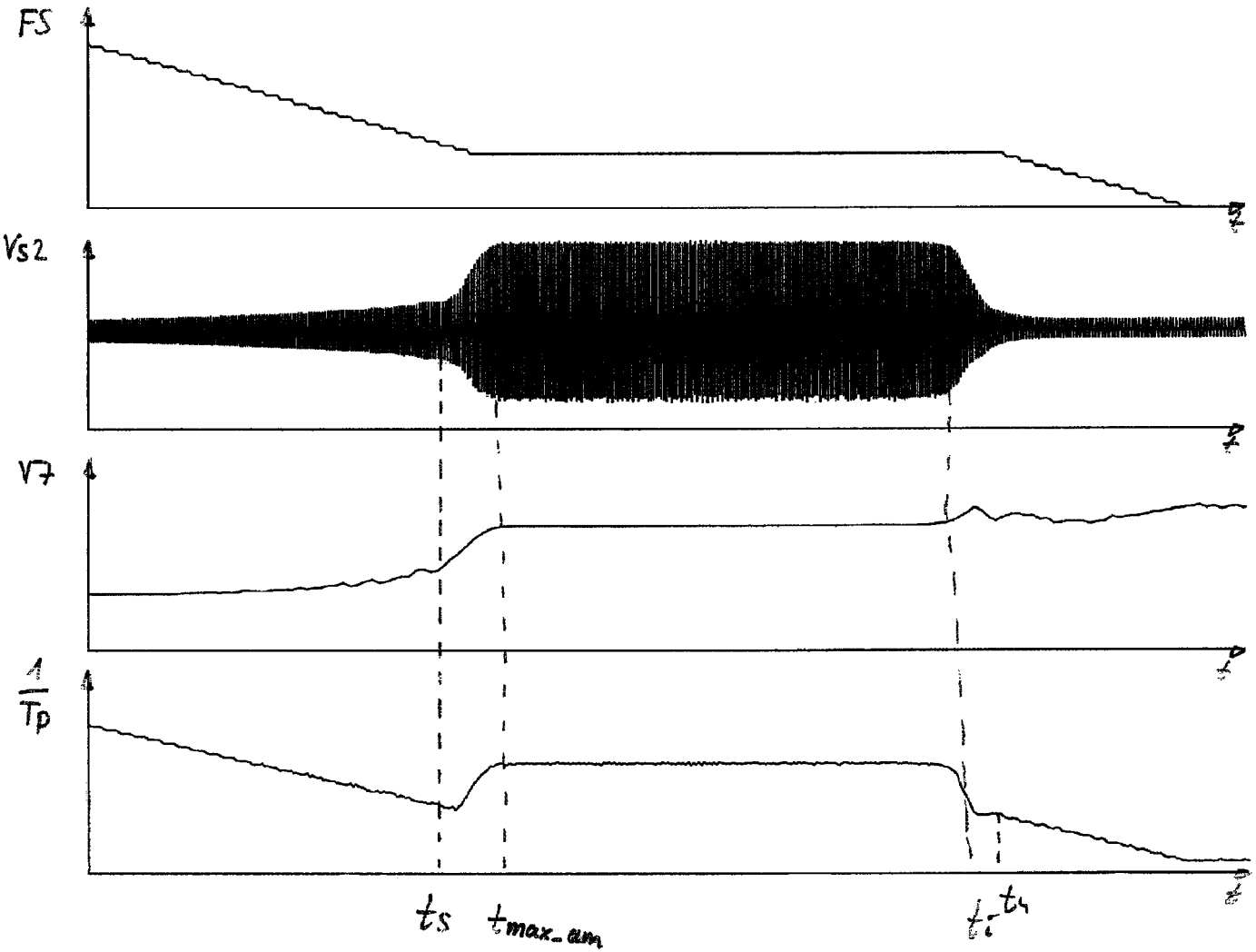
FIG. 17 illustrates the functioning of the lamp ballast during an ignition process on the basis of signal profiles.

In FIG. 17, ts designates an instant at which the resonant circuit inductance starts to go to saturation. The amplitude of the current measurement signal Vs2 then rises significantly more rapidly. In this case, an abrupt rise in the amplitude can be prevented for example by the measures explained with reference to FIGS. 9 and 14, wherein the current measurement signal, via a coupling capacitor 84 or a controlled current source 83, directly influences the generation of the switched-on duration control signal S7, whereby a shortening of the switched-on duration is already achieved even before a shortening of the switched-on duration can be achieved by using the comparison signal V7.

During the rise in the current amplitude, the excitation frequency f increases owing to the shortening of the switched-on durations. This increased frequency lies for example in the region of 50 kHz. The oscillator then operates in the saturation operating state, that is to say that the switched-on duration control signal S7 determines the excitation frequency, and not the frequency signal FS any longer. This transition of the oscillator 6 into the saturation operating state is detected by the sequence controller (not illustrated), which thereupon does not reduce the frequency signal further. Such a detection of the saturation operating state can be effected, referring to FIG. 7, for example by comparing the temporal position of a reset pulse generated by the comparator 67 and of a pulse of the switched-on duration control signal S7 with one another. If the pulse of the switched-on duration control signal S7 temporally precedes the reset pulse of the comparator during a plurality of successive drive cycles, then it can be assumed that the oscillator 6 is in the saturation operating state.

The above-explained control of the comparison signal V7, for example by using a P1 controller, prevents an uncontrolled rise in the resonant circuit amplitude during this operating state. In the example illustrated, a rise in the comparison signal V7 after the saturation instant ts can be explained by the fact that the rate of current rise or the determined temporal change ΔV in the current measurement signal Vs2 at this instant still lies below the desired value/reference value. As a result, the oscillation amplitude still increases until an instant tmax_am, at which the temporal change ΔV in the current measurement signal Vs2 attains the reference value, such that no further rise in the comparison value V7 takes place any more. If the comparison signal were not readjusted at the limit between normal operating state and saturation operating state, the comparison signal would be virtually constant until the beginning of the saturation operating state.

In FIG. 17, ti designates an instant at which the lamp ignites. The active power taken up by the lamp in this case rises to an extent such that the oscillation amplitude collapses. The controller 7 initially still attempts to take countermeasures and raises the comparison signal V7 further. Owing to the smaller oscillation amplitude and the longer switched-on duration resulting therefrom, the excitation frequency decreases again.

In FIG. 17, tn designates an instant at which the comparison signal V7 has risen to an extent such that the normal operating state of the oscillator 6 has been attained again. The sequence controller detects this transition of the oscillator into the normal operating state and reduces the frequency signal FS, after a short delay time, further down to an operating frequency lying for example in the region of 40 kHz.

The above-explained method for controlling the ignition voltage operates very stably and accurately in the case of a constant load or in the case of a slowly changing load. In one embodiment, even lamp circuits with current preheating, in which the lamp takes up a very high active power for the heating filaments connected in series with the resonance capacitor, can be controlled sufficiently accurately. Particularly in the case of cold start devices, in which the lamp is not preheated by the ignition, it can happen, however, that firstly a corona discharge of the lamp commences and the lamp in this case takes up active power, to which the ignition controller reacts by raising the comparison value V7 in order to provide the active power consumed. However, the corona discharge can spontaneously also cease occasionally, whereby the oscillation amplitude of the resonant circuit current I1 rises relatively rapidly owing to the high active power provided. For stability reasons, however, the controller 72 of the evaluation circuit is dimensioned in such a way that it cannot react rapidly enough to such a very rapid rise. In this case, a shutdown will occur owing to overcurrent by using an overcurrent protection circuit (not illustrated in more specific detail) present in the half-bridge.

Figure 18:
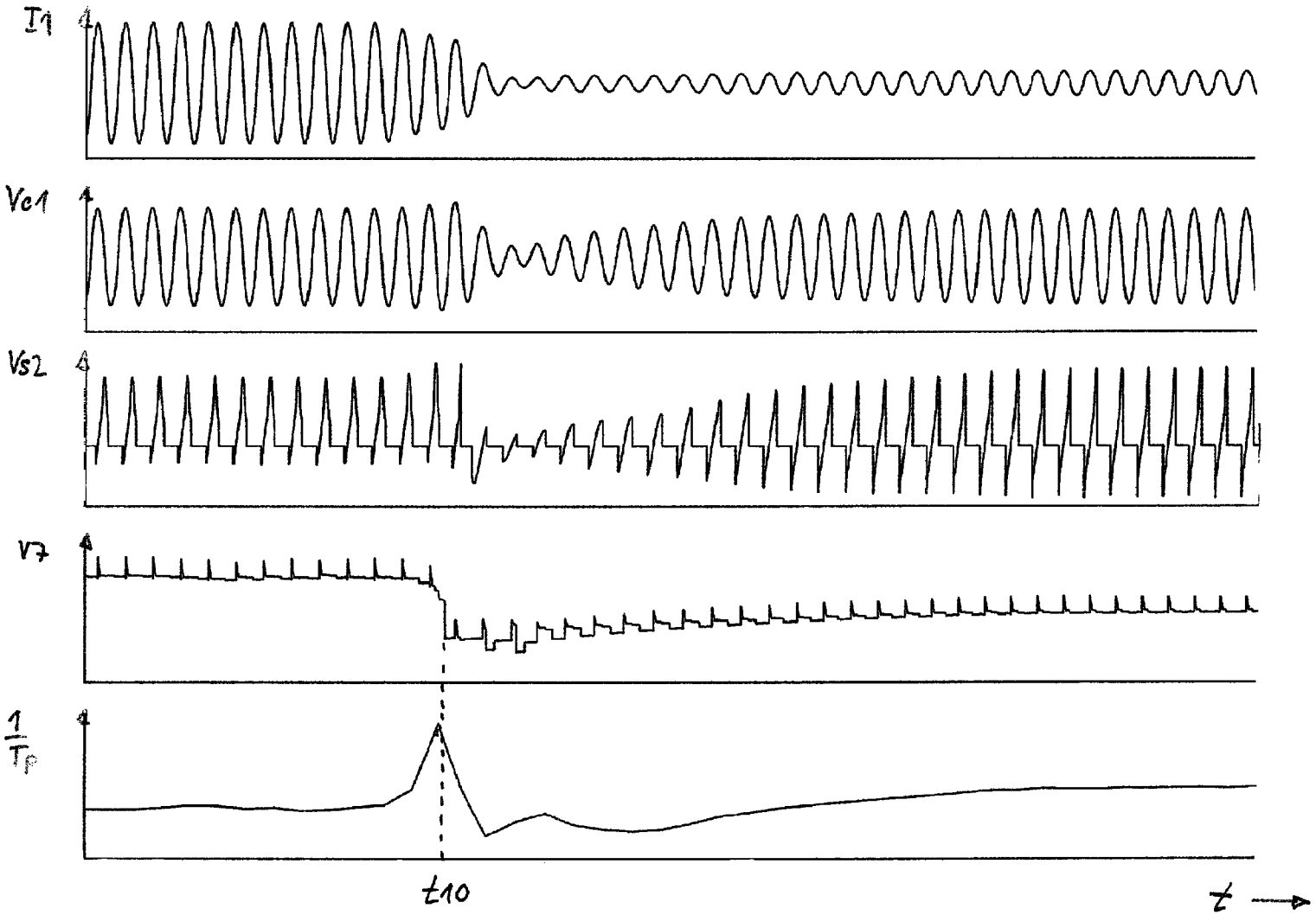
FIG. 18 illustrates the functioning of one embodiment of a lamp ballast on the basis of signal profiles.

In order to avoid such a switch-off owing to overcurrent, one embodiment provides for evaluating the input signal of the controller 72 or the proportional component of the comparison signal V7 independently of the integral component and, in the case of a rapid rise in the proportional component, reducing the comparison signal V7 abruptly to a small value, to be precise to such a value which is usually established without an active-power load. From this new start value of the comparison value V7, the oscillation amplitude cannot at least rapidly rise further and the controller 72 has time to settle again under the changed load conditions. Such a process is illustrated in FIG. 18, in which the current I1 through the lamp, the voltage Vc1 across the lamp, the current measurement signal Vs2, the comparison signal V7 and the resonant circuit frequency f=1/Tp for this case are illustrated against time. Here t10 designates an instant after which the comparison signal V7 is reduced.

In the case of a strong saturation of the resonant circuit inductance, the profile of the resonant circuit voltage changes from a sinusoidal profile to a trapezoidal profile. In this case, the root-mean-square value, which is critical for ignition of the lamp, is higher for the same amplitude in the case of a trapezoidal voltage profile than in the case of a sinusoidal voltage profile. One embodiment provides, then, for detecting the saturation depth, that is to say for detecting how strongly the resonant circuit inductance is operated in saturation. This can be done for example by evaluating the peak current or the maximum value of the current measurement signal Vs2. In this case, the saturation depth is all the higher, the higher the maximum value. In the case of a high saturation depth and a trapezoidal voltage profile resulting therefrom, provision is made for reducing the oscillation amplitude established under the control of the comparison signal V7 during the saturation operating state. This is done, for example, by a comparison signal being generated in a manner dependent on the saturation depth and being reduced in the case of a high saturation depth. This can be done, in the case of the controller 7 illustrated in FIG. 15, for example by charge additionally being fed into the switched capacitances 74, 75.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method for driving a fluorescent lamp connected to a series resonant circuit having a resonant circuit inductance and a resonant circuit capacitance, comprising:

applying an excitation AC voltage having an excitation frequency to the series resonant circuit using a half-bridge circuit, having an output, to which the series resonant circuit is coupled, and having a first and a second switch, driven in the on state and in the off state with a fundamental frequency predetermined by a frequency signal or with an increased frequency with respect to the fundamental frequency;

detecting a resonant circuit current flowing through the resonant circuit;

driving the switches with the fundamental frequency or with the increased frequency with respect to the fundamental frequency in a manner dependent on a temporal change in the resonant circuit current between two temporally spaced-apart evaluation instants lying within a switched-on duration of one of the switches;

during a switched-on duration of one of the switches, switching off the switch at the latest after a predetermined maximum time duration has elapsed after the presence of a predetermined phase angle of the resonant circuit current, wherein the time duration is dependent on a temporal change in the resonant circuit current between two temporally spaced-apart evaluation instants lying within the switched-on duration;

determining a first difference value, dependent on a difference between values of the resonant circuit current at the evaluation instants;

determining a second difference value, dependent on a difference between the first difference value and a reference value; and setting the maximum time duration such that it is dependent on at least one second difference value that was determined for one switched-on duration.

2. The method of claim 1, wherein the predetermined phase angle is a zero crossing of the resonant circuit current.

3. The method of claim 1, comprising:

determining a switched-on duration of one switch; and driving the other switch in the on state in the case of a subsequent driving in the on state for a time duration lying between the switched-on duration of the one switch and a switched-on duration determined by the frequency signal.

4. The method of claim 3, wherein the switched-on duration of the other switch corresponds to the switched-on duration of the one switch.

5. The method of claim 1, comprising setting the maximum time duration such that it is dependent on a plurality of second difference values that were determined during a plurality of switched-on durations.

6. The method of claim 5, wherein the maximum time duration has a proportional component, proportional to one of the second difference values, and an integral component, dependent on the integral of a plurality of second difference values.

7. A method for driving a fluorescent lamp connected to a series resonant circuit having a resonant circuit inductance and a resonant circuit capacitance, comprising:

applying an excitation AC voltage having an excitation frequency to the series resonant circuit using a half-bridge circuit, having an output, to which the series resonant circuit is coupled, and having a first and a second switch, driven in the on state and in the off state with a fundamental frequency predetermined by a frequency signal or with an increased frequency with respect to the fundamental frequency;

detecting a resonant circuit current flowing through the resonant circuit;

driving the switches with the fundamental frequency or with the increased frequency with respect to the fundamental frequency in a manner dependent on a temporal change in the resonant circuit current between two temporally spaced-apart evaluation instants lying within a switched-on duration of one of the switches;

during a switched-on duration of one of the switches, switching off the switch at the latest after a predetermined maximum time duration has elapsed after the presence of a predetermined phase angle of the resonant circuit current, wherein the time duration is dependent on a temporal change in the resonant circuit current between two temporally spaced-apart evaluation instants lying within the switched-on duration;

determining a first difference value, dependent on a temporal difference between the evaluation instants, wherein a first evaluation instant is present when the resonant circuit current assumes a first reference value, and wherein an evaluation instant is present when the resonant circuit current assumes a second reference value;

determining a second difference value, dependent on a difference between a value dependent on a reciprocal of the first difference value and a reference value;

setting the maximum time duration such that it is dependent on at least one second difference value that was determined for one switched-on duration.

8. A lamp ballast comprising:

a series resonant circuit having connection terminals for connecting a fluorescent lamp;

a half-bridge circuit having a first and a second switch and having an output, which is connected to the series resonant circuit;

a drive circuit, designed to drive first and second switches alternately in the on state and in the off state with a fundamental frequency dependent on a frequency signal or with an increased frequency with respect to the fundamental frequency, and designed to detect a current through the series resonant circuit and, in a manner dependent on a temporal change in the resonant circuit current between two temporally spaced-apart evaluation instants lying within a switched-on duration of one of the switches to drive the switches with the fundamental frequency or with an increased frequency with respect to the fundamental frequency;

an oscillator, to which the frequency signal and a switched-on duration control signal are fed and which, in a manner dependent on the switched-on duration control signal, provides an oscillator signal with a fundamental frequency dependent on the frequency signal or with an increased frequency with respect to the fundamental frequency;

a drive signal generating circuit, to which the oscillator signal is fed and which is designed to generate a first drive signal for the first switch and a second drive signal for the second switch in a manner dependent on the oscillator signal;

a current measurement arrangement, designed to generate a current measurement signal dependent at least occasionally on a current through the resonant circuit; and a switched-on duration control circuit designed to determine a temporal change in the current measurement signal between two temporally spaced-apart evaluation instants lying within a switched-on duration of one of the switches and to generate the switched-on duration control signal in a manner dependent on the temporal change.

9. The lamp ballast of claim 8, wherein the switched-on duration control circuit comprises:

a phase detector, to which the current measurement signal is fed and provides a phase detection signal;

a time measurement arrangement, which can be activated and deactivated by the phase detection signal and designed to provide, in the activated state, a time measurement signal that rises over time;

a comparison value generating circuit, to which the current measurement signal is fed and designed to generate a comparison value dependent on a temporal change in the current measurement signal between two temporally spaced-apart evaluation instants lying within a switched-on duration of one of the switches; and a comparator, to which the time measurement signal and the comparison value are fed and which generates the switched-on duration control signal in a manner dependent on a comparison of the time measurement signal with the comparison value.

10. The lamp ballast of claim 9, wherein the time measurement arrangement is designed to generate the time measurement signal such that a temporal change in the time measurement signal is dependent on the current measurement signal.

11. The lamp ballast of claim 9, wherein the comparison value generating circuit comprises:

a sampling unit, to which the current measurement signal is fed and designed to generate a change value dependent on a temporal change in the current measurement signal; and a controller, to which the change value is fed and which provides the comparison value.

12. The lamp ballast of claim 11, wherein the controller is a PI controller.

13. The lamp ballast of claim 8, wherein the switched-on duration control circuit is designed to generate the switched-on duration control signal in a manner dependent on the current measurement signal.

14. A lamp system comprising:

a drive circuit configured to drive first and second switches alternately in an on state and in an off state, and configured to drive the first and second switches with a frequency, dependent on a temporally spaced-apart evaluation instants lying within a switched-on duration of one of the first and second switches; and a switched-on duration control circuit, wherein the switched-on duration control circuit is configured to determine a temporal change in a current measurement signal between two temporally spaced-apart evaluation instants within a switched-on duration of one of the first and second switches.

15. The system of claim 14, comprising:

a series resonant circuit configured to couple to a lamp.

16. The system of claim 15, comprising:

a current measurement arrangement configured to provide the current measurement signal dependent on the resonant circuit.

17. The system of claim 14, wherein the drive circuit comprises:

an oscillator; and a drive signal generating circuit coupled to the oscillator.

18. The system of claim 14, wherein the switched-on duration control circuit is configured to generate a switched-on duration control signal dependent on the temporal change.

19. The system of claim 14, wherein the switched-on duration control circuit comprises a phase detector, a time measurement arrangement, a comparison value generating circuit and a comparator.

* * * * *